US010603647B2

(12) United States Patent
Richardson

(10) Patent No.: US 10,603,647 B2
(45) Date of Patent: Mar. 31, 2020

(54) MICROSTRUCTURE FLOW MIXING DEVICES

(71) Applicant: IMAGINE TF, LLC, Los Gatos, CA (US)

(72) Inventor: Brian Edward Richardson, Los Gatos, CA (US)

(73) Assignee: Imagine TF, LLC, Los Gatos, CA (US)

( * ) Notice: Subject to any disclaimer, the term of this patent is extended or adjusted under 35 U.S.C. 154(b) by 35 days.

(21) Appl. No.: 15/827,892

(22) Filed: Nov. 30, 2017

(65) Prior Publication Data

US 2018/0154319 A1 Jun. 7, 2018

Related U.S. Application Data

(60) Provisional application No. 62/497,752, filed on Dec. 1, 2016, provisional application No. 62/498,303, filed on Dec. 20, 2016, provisional application No. 62/602,363, filed on Apr. 20, 2017.

(51) Int. Cl.
*B01F 13/00* (2006.01)
*B01F 5/06* (2006.01)
*B01F 5/00* (2006.01)

(52) U.S. Cl.
CPC ..... *B01F 13/0096* (2013.01); *B01F 5/0604* (2013.01); *B01F 13/0061* (2013.01); *B01F 13/0064* (2013.01)

(58) Field of Classification Search
CPC ..... B01F 13/0061; B01F 13/0064; B01F 13/0096; B01F 5/0604
See application file for complete search history.

(56) References Cited

U.S. PATENT DOCUMENTS 3,476,521 A * 11/1969 Wise ..... C08F 10/00 422/138
3,901,731 A * 8/1975 Warszawski ..... C25B 11/02 429/9
4,316,673 A * 2/1982 Speer ..... B01F 5/0609 366/337
5,137,369 A * 8/1992 Hodan ..... B01F 5/0604 366/337
5,304,487 A * 4/1994 Wilding ..... B01J 19/0093 210/500.26
5,427,663 A * 6/1995 Austin ..... B01J 19/0093 204/450
5,486,335 A * 1/1996 Wilding ..... B01F 15/0264 366/DIG. 3
5,587,128 A * 12/1996 Wilding ..... B01D 61/18 216/2

(Continued)

*Primary Examiner* — Tony G Soohoo

(74) *Attorney, Agent, or Firm* — Keith Kline; The Kline Law Firm PC

(57) ABSTRACT

Microstructure flow mixing devices are disclosed herein. An example device a first panel, a first plurality of raised features extending from a first surface of the first panel, a second plurality of raised features extending from the first surface of the first panel and a plurality of divider microstructures extending from the first surface of the first panel in line with and in between the first plurality of raised features and the second plurality of raised features. At least a portion of adjacent divider microstructures are spaced apart to form feed pathways or cross channels.

19 Claims, 23 Drawing Sheets

(56) References Cited

U.S. PATENT DOCUMENTS 5,726,026 A * 3/1998 Wilding ..... B01D 67/0062 366/DIG. 3
5,921,678 A * 7/1999 Desai ..... B01F 5/0256 366/173.1
6,106,146 A * 8/2000 Langecker ..... B01F 5/0646 366/336
6,156,273 A * 12/2000 Regnier ..... B01J 20/281 204/450
6,241,379 B1 * 6/2001 Larsen ..... B01F 5/0453 366/181.5
6,368,871 B1 * 4/2002 Christel ..... B01F 5/0403 204/450
6,392,007 B1 * 5/2002 Buchanan ..... B01F 5/0604 264/171.1
6,457,854 B1 * 10/2002 Koop ..... B01F 5/064 366/336
6,494,614 B1 * 12/2002 Bennett ..... B01D 61/28 210/321.84
6,685,810 B2 * 2/2004 Noca ..... G01N 27/44704 204/450
7,143,900 B2 * 12/2006 Hernandez ..... B01D 29/012 210/498
7,169,251 B2 * 1/2007 Guo ..... B01L 3/502707 156/237
7,485,454 B1 * 2/2009 Jury ..... B01F 5/0256 435/286.7
7,686,029 B2 * 3/2010 Nakao ..... B01L 3/502723 137/177
7,695,956 B2 * 4/2010 Tsinberg ..... G01N 1/40 422/50
7,794,136 B2 * 9/2010 Yang ..... B01F 5/061 366/336
8,021,614 B2 * 9/2011 Huang ..... B01L 3/502746 422/73
8,158,410 B2 * 4/2012 Tang ..... G01N 1/40 422/50
8,192,980 B2 * 6/2012 Combette ..... B01J 19/0093 422/130
8,722,423 B2 * 5/2014 Bergman ..... B01J 20/28014 436/514
9,212,977 B2 * 12/2015 Tang ..... B01F 5/102
9,658,184 B2 * 5/2017 Luan ..... B82Y 30/00
2005/0042766 A1 * 2/2005 Ohman ..... B01L 3/50273 436/174
2006/0000772 A1 * 1/2006 Sano ..... B01D 67/0062 210/635
2007/0026469 A1 * 2/2007 Fuchs ..... B01L 3/502707 435/7.23
2007/0059716 A1 * 3/2007 Balis ..... B01L 3/502746 435/6.11
2007/0059718 A1 * 3/2007 Toner ..... B01L 3/502746 435/6.11
2007/0140042 A1 * 6/2007 Schanz ..... B01F 5/0475 366/130
2007/0196820 A1 * 8/2007 Kapur ..... B01L 3/502746 435/5
2009/0136982 A1 * 5/2009 Tang ..... B01F 5/102 435/29
2010/0167337 A1 * 7/2010 Tsinberg ..... G01N 1/2813 435/29

* cited by examiner

MICROSTRUCTURE FLOW MIXING DEVICES

CROSS REFERENCE TO RELATED APPLICATIONS

This application claims the benefit and priority of U.S. Provisional Application 62/497,752, filed on Dec. 1, 2016; and the benefit and priority of U.S. Provisional Application 62/498,303, filed on Dec. 20, 2016; and the benefit and priority of U.S. Provisional Application 62/602,363, filed on Apr. 20, 2017, all of which are hereby incorporated by reference herein in their entireties including all references and appendices cited therein, for all purposes.

FIELD OF THE PRESENT DISCLOSURE

The present disclosure relates generally to fluid mixing devices, and more specifically, but no by limitation, to various devices that provide for efficient mixing of fluids using both laminar and turbulent flow through microstructure panels.

SUMMARY

Various embodiments of the present disclosure are directed to a device comprising: a first panel; a first plurality of raised features extending from a first surface of the first panel, the first plurality of raised features being spaced apart from one another and disposed at an end of one edge of the first panel to form first inlets; a second plurality of raised features extending from the first surface of the first panel, the second plurality of raised features being spaced apart from one another and disposed at an end of one edge of the first panel to form outlets; and a plurality of divider microstructures extending from the first surface of the first panel in line with and in between the first plurality of raised features and the second plurality of raised features, wherein at least a portion of adjacent divider microstructures are spaced apart to form feed pathways.

Various embodiments of the present disclosure are directed to a device comprising: a housing sub-assembly comprising: a tubular portion having a lower sidewall comprising an outlet; a cover portion that mates with the tubular portion, the cover portion comprising a first inlet and a second inlet; and a mixing sub-assembly comprising a plurality of stacked mixing plates forming an outlet plenum, wherein the mixing sub-assembly is disposed in the tubular portion; and wherein when the cover portion is joined to the tubular portion, a plug of the cover portion seals the outlet plenum of the mixing sub-assembly and forms a first inlet plenum that is in fluid communication with both the first inlet and the second inlet.

BRIEF DESCRIPTION OF THE DRAWINGS

The accompanying drawings, where like reference numerals refer to identical or functionally similar elements throughout the separate views, together with the detailed description below, are incorporated in and form part of the specification, and serve to further illustrate embodiments of concepts that include the claimed disclosure, and explain various principles and advantages of those embodiments.

The methods and systems disclosed herein have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

DESCRIPTION OF EXEMPLARY EMBODIMENTS

According to some embodiments, the present disclosure is generally directed to various panels that can be used to mix fluids using microstructures in varying arrangements. The types of fluids introduced into the device would determine whether a mixture or an emulsion is produced.

Figure 1:
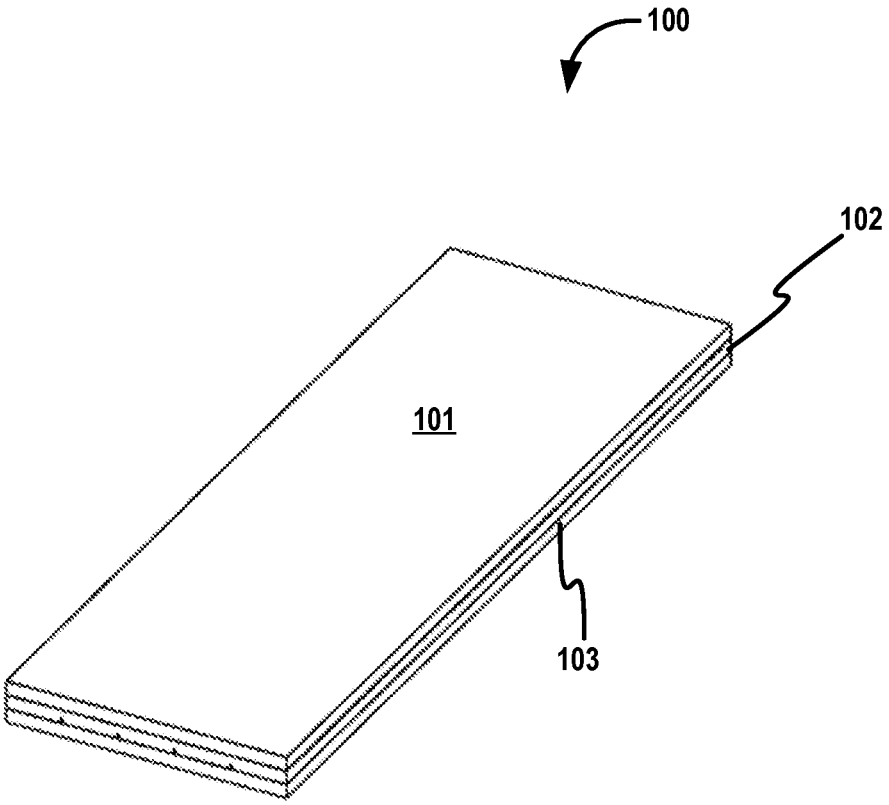
FIG. 1 is a perspective view of an example panel array or device constructed in accordance with the present disclosure.

FIG. 1 is an isometric view of an example device of the present disclosure. The device 100 comprises a plurality of panels, such as panel 102, stacked in an array. In one or more embodiments, a first cover panel 101 and a second cover panel 103 are stacked in layered relationship with panel 102.

Figure 2:
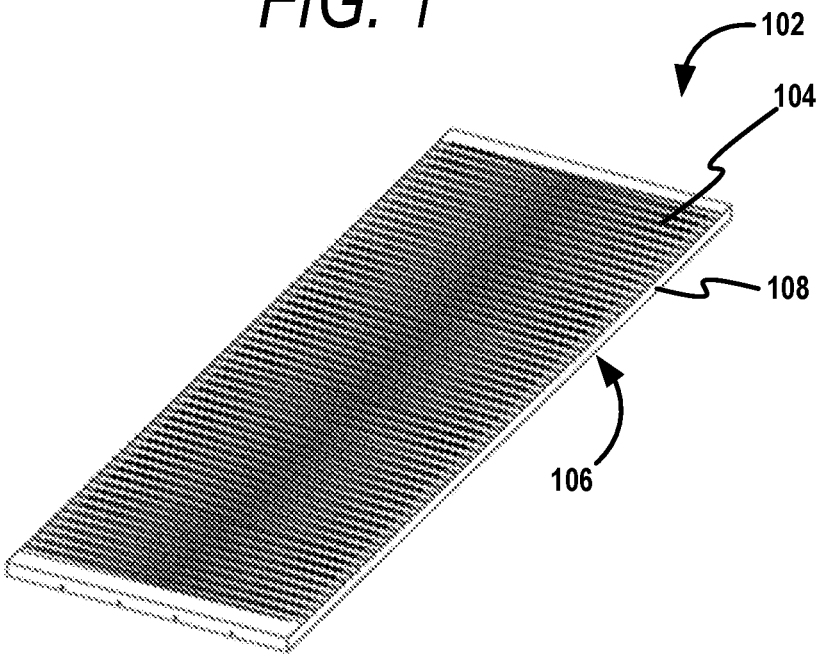
FIG. 2 is a perspective view of an example panel of the array in FIG. 1.

In some embodiments, as in FIG. 2, the panel 102 comprises a plurality of raised features and microstructures that dictate flow of fluids across various surfaces of the panel 102. In one embodiment, the panel 102 comprises a first surface 104 and a second surface 106. A peripheral sidewall 108 extends around the perimeter edge of the panel 102.

Figure 3:
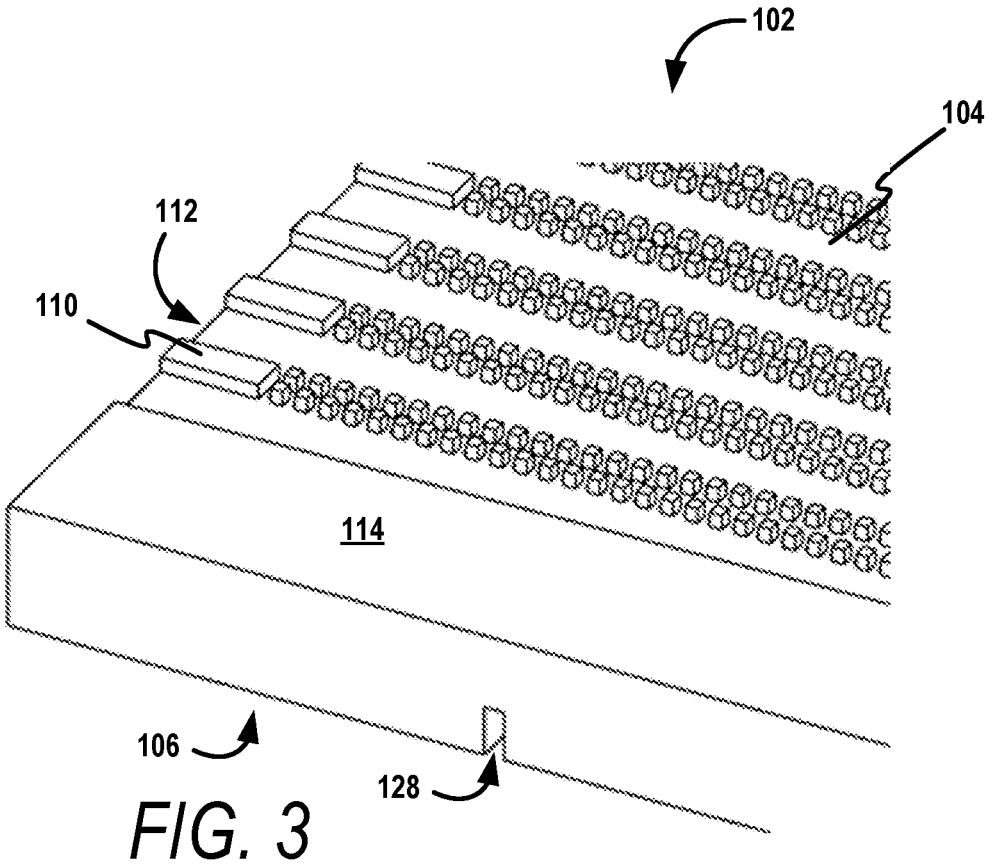
FIG. 3 is a close-up perspective view illustrating a portion of the upper surface of the panel.
Figure 4:
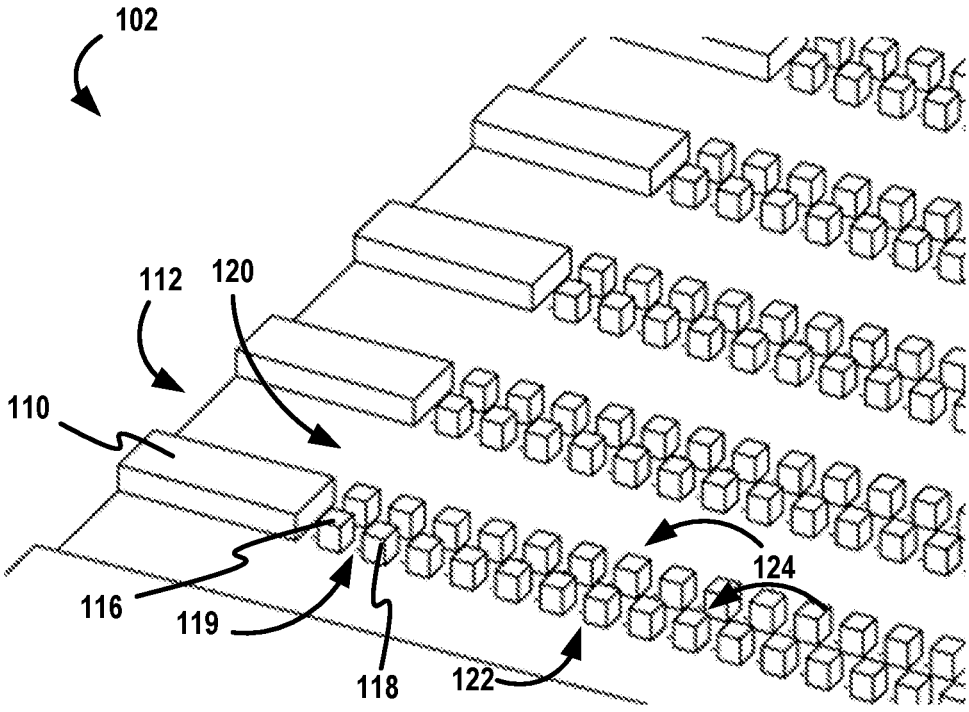
FIG. 4 is a close-up perspective view of FIG. 3.

FIGS. 3 and 4 collectively illustrate various mixing elements disposed on the first surface 104 of the panel 102. For example, a first plurality of raised features, such as raised feature 110 extend from the first surface of the panel. This first plurality of raised features are spaced apart from one another and disposed at an end of one edge of the panel to form a series of first inlets, such as inlet 112. In more detail, the raised feature 110 is a cubic rectangle having a length dimension that is longer than its width dimension. The raised feature 110 is spaced apart from an adjacent raised feature to form the inlet 112. The outermost raised feature forms one of the first inlets when spaced apart from a fence 114. In some embodiments, the fence 114 extends along an edge of the panel 102.

In one or more embodiments, the panel 102 comprises a plurality of divider microstructures, such as divider microstructure 116 that extend from the first surface 104 of the panel 102 in line with and in between the first plurality of raised features 110 and a second plurality of raised features (described in greater detail infra). These are also raised cubic features but could comprise any desired geometry.

In various embodiments, at least a portion of adjacent divider microstructures are spaced apart to form feed pathways or cross channels. For example, a feed pathway 119 is formed by the spacing of divider microstructure 116 and divider microstructure 118. A feed pathway 119 is created between the divider microstructure 116 and the raised feature 110 as well.

The raised features and divider microstructures on the panel 102 create pathways for fluid to flow across the first surface 104 of the panel 102. For example, a first pathway or plenum, such as first plenum 120 extends in line with each of the first inlets, such as inlet 112. Due to the spacing between divider microstructures, fluid entering the first inlets will enter divider microstructure pathways that extend between rows of divider microstructures. For example, the divider microstructures are arranged into rows. For example, divider microstructure row 122 and divider microstructure row 124 are spaced apart from one another to form a divider microstructure pathway 126. In operation, fluid entering the inlet 112 can flow across the outer perimeter of the divider microstructure row 122 through the first plenum 120. A portion of this fluid will migrate across the feed pathways and into the divider microstructure pathway resulting in divergent fluid flow.

The first plenums associated defined between the inlets and rows of divider microstructures provide a substantially consistent flow rate of fluid into the feed pathways for even distribution.

While discussed in greater detail below, the second surface 106 of the panel 102 comprises a plurality of second inlets, such as second inlet 128 that are disposed orthogonally to the first inlets. These pathways provide fluid flow across the panel in a direction that is orthogonal to pathways of fluid communication of the first inlets. In some embodiments, the second inlets are utilized to introduce a second fluid over the first surface 104 of the panel that is different from a first fluid provided through the first inlets. The first and second fluids will mix when passing across the divider microstructures and exit through outlets in the panel. The mixing is facilitated when the second fluid is delivered through feed apertures that extend from the back surface to the front surface, as will be discussed in greater detail below.

Figure 5:
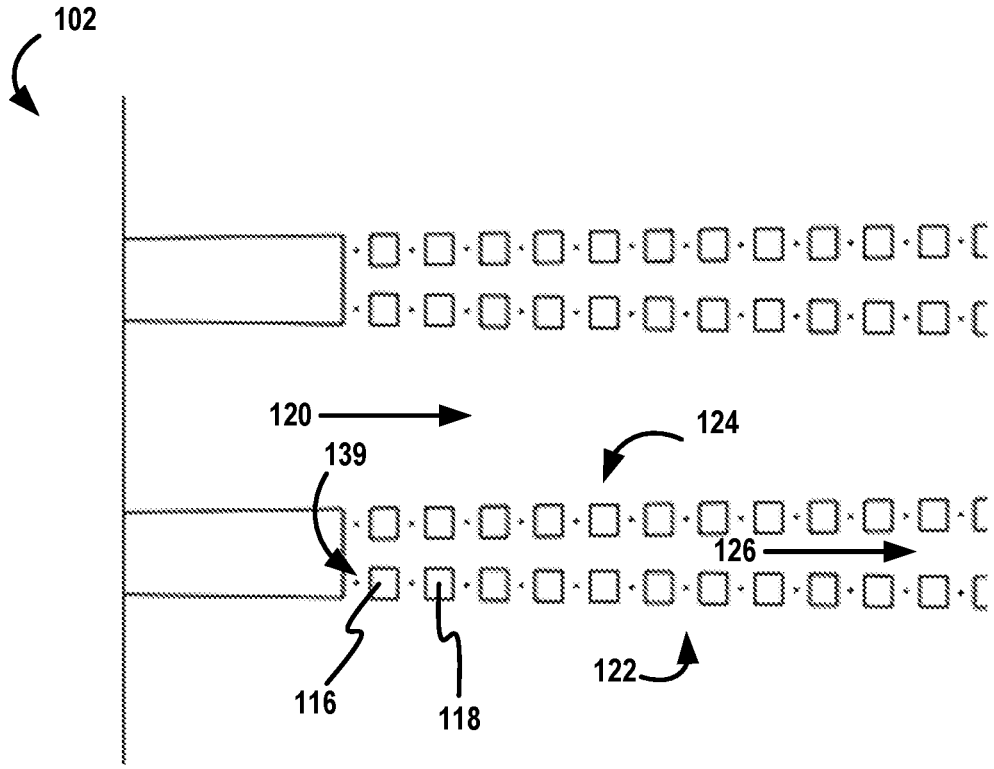
FIG. 5 is a top down view of a portion of the panel illustrating raised features and divider microstructure rows.

FIG. 5 is a top down view of a portion of the panel 102 illustrating that divider microstructure row 122 and divider microstructure row 124 diverge away from one another. The divider microstructure pathway 126 (also referred to as a v-shaped outlet channel) has a v-shaped configuration. Also, divider microstructure 118 is offset (as well as each successive divider microstructure) from divider microstructure 116 to create the v-shaped divider microstructure pathway 126. This offset causes fluid traveling through the first plenum 120 to deflect off the divider microstructures across the feed pathways.

Figure 6:
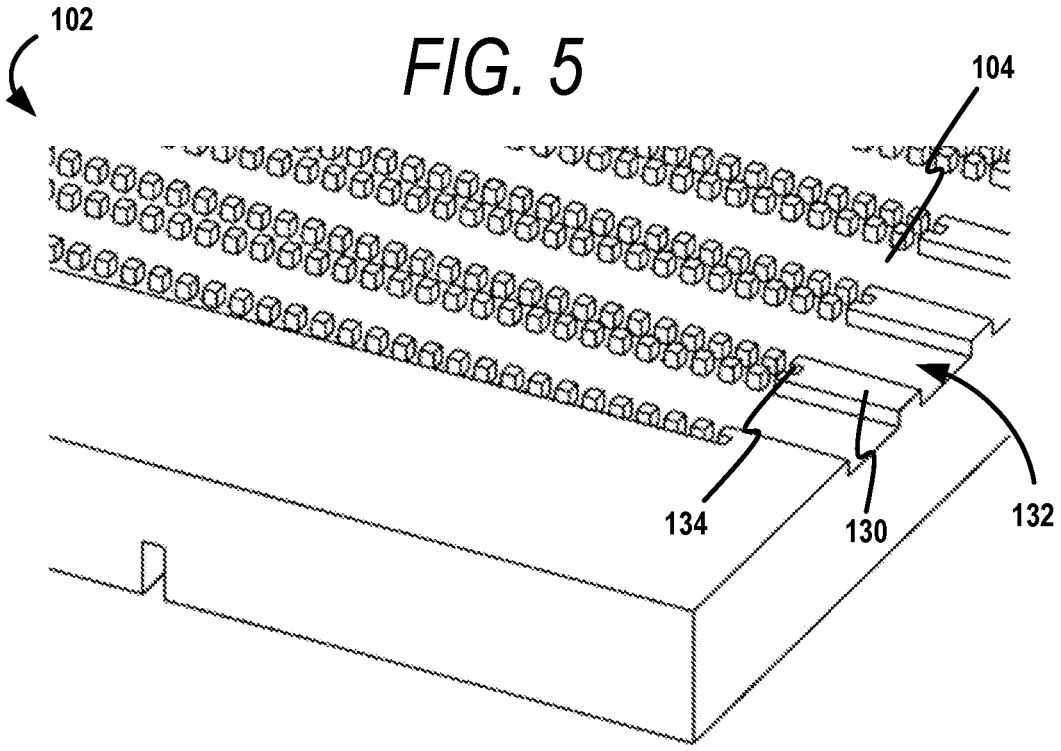
FIG. 6 is a perspective view of another end of the panel opposite that which is illustrated in FIG. 4.

FIG. 6 is a perspective view of an opposite end of the panel 102 relative to FIGS. 3 and 4. A second plurality of raised features, such as raised feature 130, extend from the first surface 104 of the panel 102. The second plurality of raised features are spaced apart from one another and disposed at an end of a second edge of the first panel to form outlets, such as outlet 132. In some embodiments, the raised feature 130 comprises a notch 134.

According to some embodiments, the divider microstructures of a row will start in proximity to a raised feature of one of the first inlets, but will diverge and align with a raised feature of one of the outlets on an opposing end of the panel, and specifically a raised feature of an outlet that is offset from the raised feature of the inlet. This provides for divider microstructure rows that form a zig-zag pattern across the first surface 104 of the panel 102. Thus, in some embodiments, the raised features that form the first inlets are offset from the raised features that define the outlets. As illustrated in FIG. 6, divider microstructure row 124 will align with raised feature 130, and raised feature 110 (see FIGS. 3 and 4) aligns with outlet 132 rather than raised feature 130.

Figure 7:
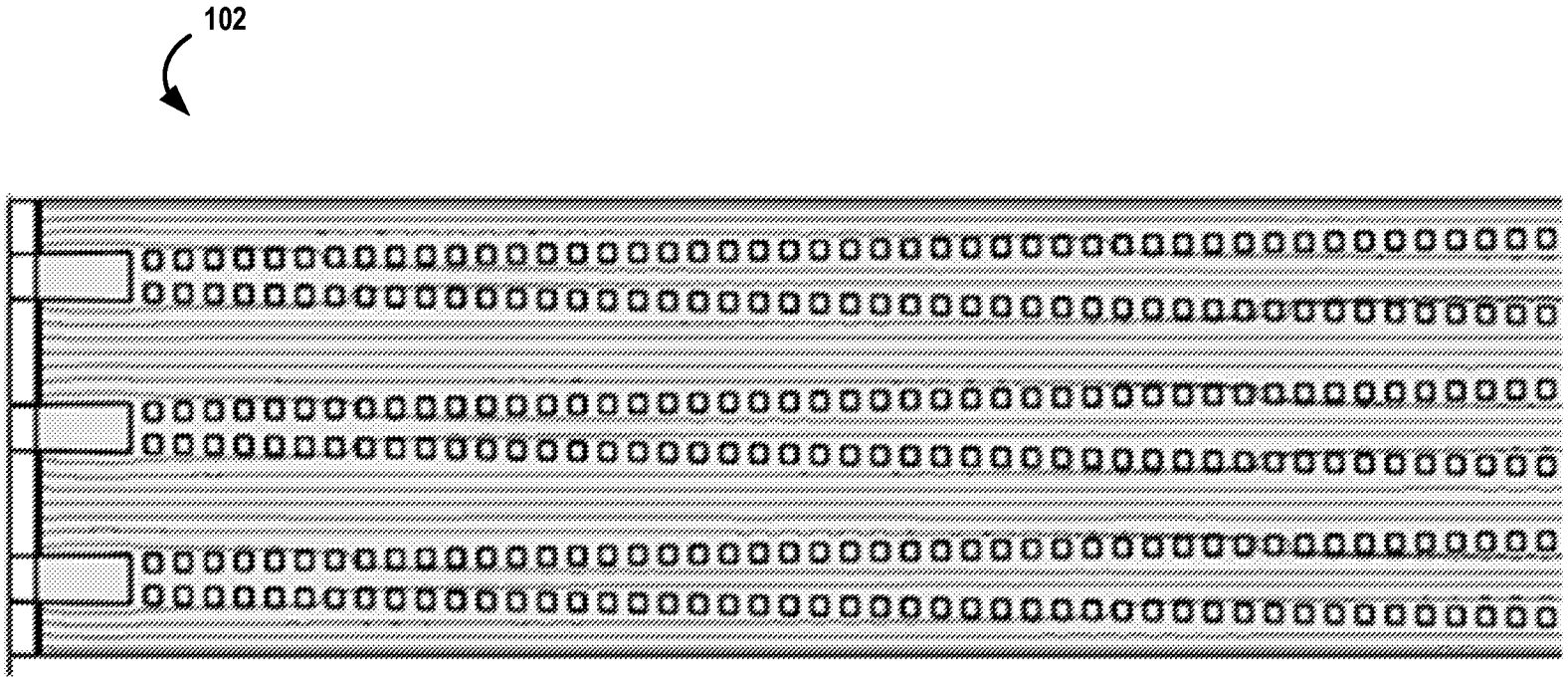
FIG. 7 is a flow simulation of fluid across a portion of the panel of FIG. 1.

FIG. 7 illustrates fluid flow through a section of the panel 102, where flow is diverted by interaction with the divider microstructures. Flow trajectories from a computational fluid dynamics simulation of the flow of a single fluid through across the panel 102. The view in FIG. 7 is illustrated without any feed aperture flow for clarity. In some embodiments, a geometry and symmetry of the fluidic pathways results in equal flow and pressure drops in the flow pathways (between divider microstructures). When equal amounts of a second fluid are delivered in the divider microstructures from the second inlets, a consistent ratio of the first fluid is mixed with the second fluid. By having a large number of cross channels the two fluids are mixed to a high degree.

Figure 8:
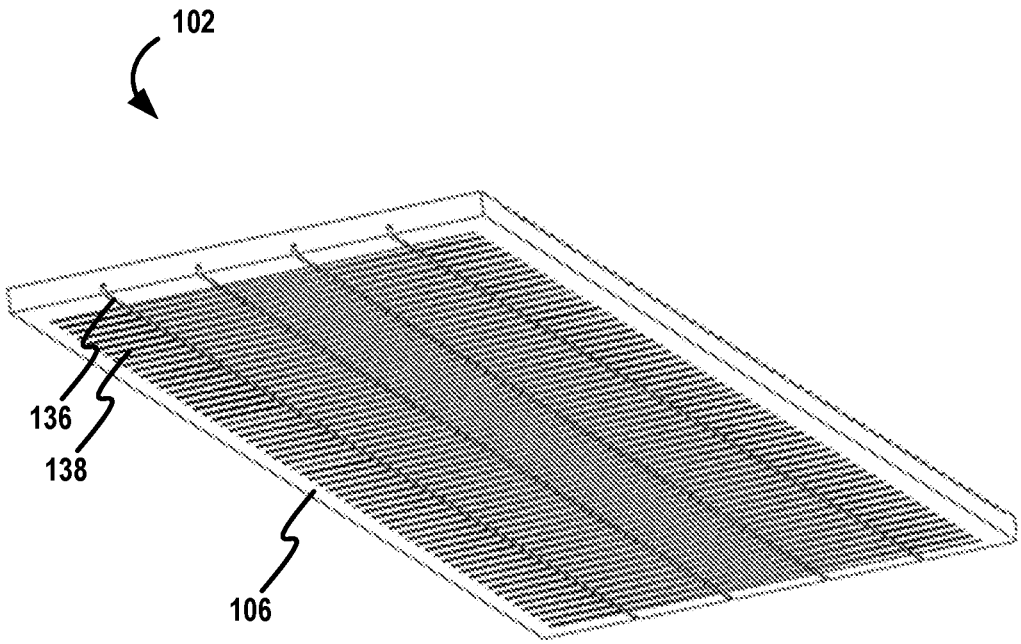
FIG. 8 is a perspective view of the panel illustrating a second surface and various features thereof.

FIG. 8 is a perspective view of the second surface 106 of the panel 102 illustrating continuous grooves or feed slots, such as continuous feed slot 136 that extend along the length of the panel. Each of the continuous grooves is associated with one of the second inlets. For example, continuous feed slot 136 is associated with second inlet 128.

Figure 9:
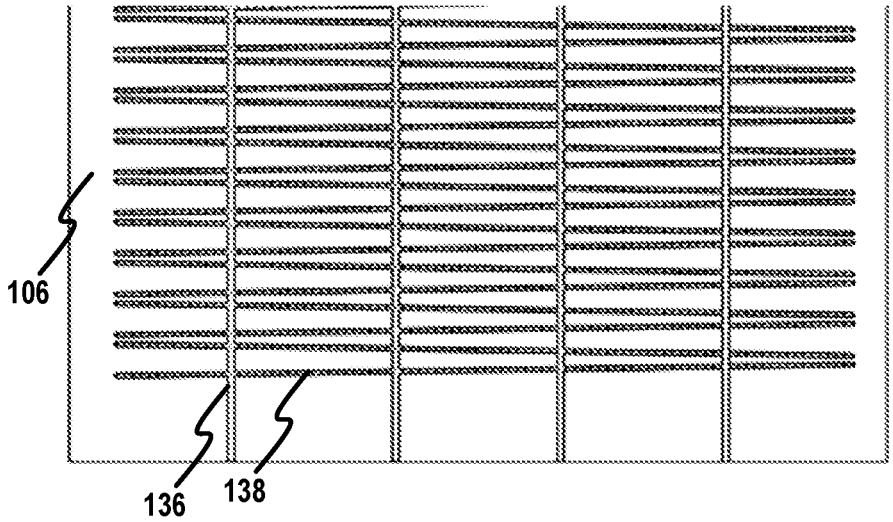
FIG. 9 is a plan view of a portion of the second surface illustrated in FIG. 8.
Figure 10:
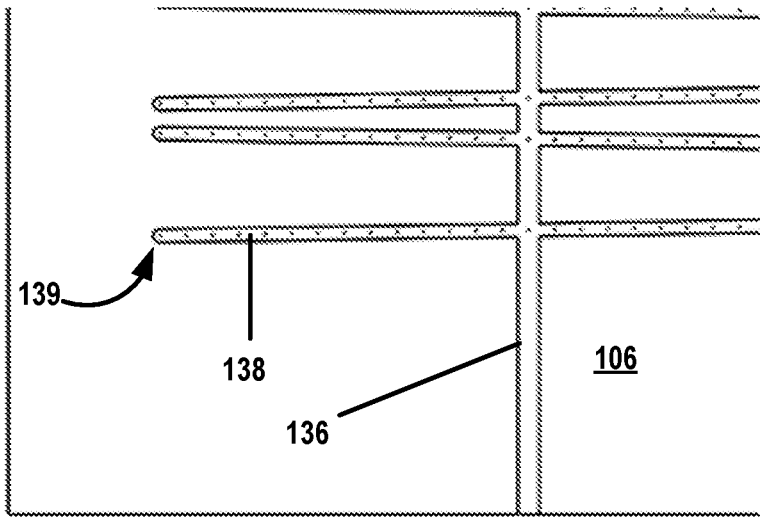
FIG. 10 is a close up view of a portion of FIG. 9.

In some embodiments, as illustrated in FIG. 9, the second surface 106 is provided with a plurality of divider microstructure feed slots, such as divider microstructure feed slot 138. These divider microstructure feed slots are align with the divider microstructures of the first surface 104 of the panel 102. A close up view of the continuous feed slot 136 and the divider microstructure feed slot 138 are illustrated in FIG. 10. As noted above, a second fluid will flow evenly through the continuous feed slots and into the divider microstructure feed slots. The continuous feed slots and divider microstructure feed slots illustrated are one of many different designs that could be engineered to deliver a second fluid orthogonally (or otherwise angled) to a first fluid.

Figure 11:
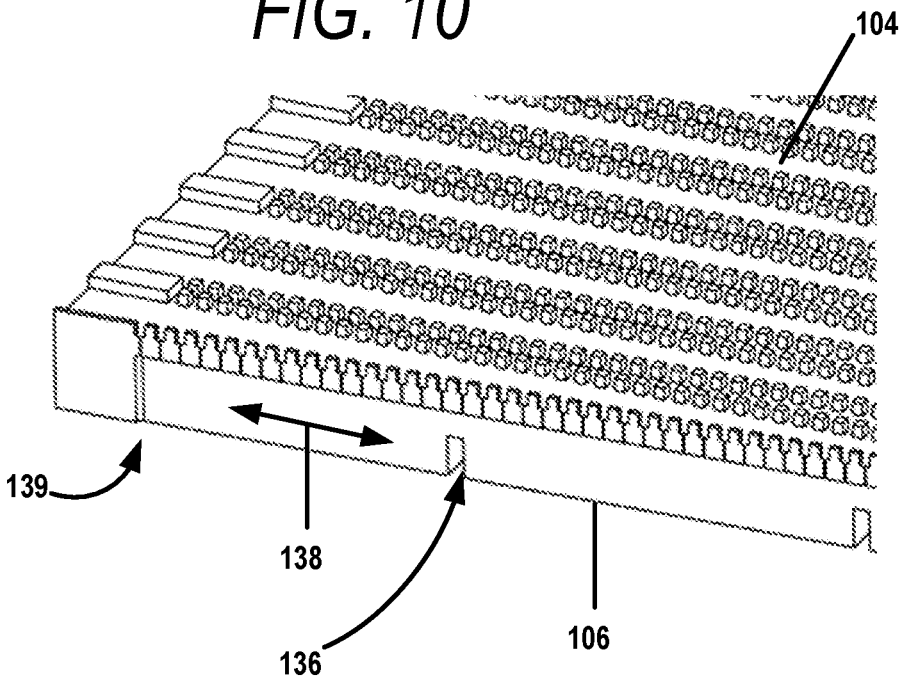
FIG. 11 is a perspective and cross sectional view of the panel illustrating feed apertures and divider microstructure feed slots.

As best illustrated in the cross section of FIG. 11, the divider microstructure feed slot 138 comprises a plurality of feed apertures, such as feed aperture 139 that provide a pathway for fluid to communicate from the second surface 106 to the first surface 104. The divider microstructure feed slot 138 is filled by the continuous feed slot 136 (which is in turn fed through a second inlet, infra).

In one embodiment, the continuous feed slots and divider microstructure feed slots function as a secondary plenum that delivers fluid at a constant pressure to each of the feed apertures. FIGS. 4 and 5 illustrate the feed aperture 139 relative to the divider microstructure 116. In general, each feed pathway between divider microstructures (and raised features on panel ends) includes a feed aperture. For example, feed aperture 139 is between divider microstructure 116 and divider microstructure 118, and within feed aperture 139. An example feed aperture 139 is also illustrated in FIG. 5. As will be discussed in greater detail with reference to FIG. 11, a plurality of feed apertures, such as feed aperture 139 are present between divider microstructures. These feed apertures provide a pathway for fluid (such as a second fluid) to communicate from a second surface of the panel 102 up into the feed pathways between adjacent divider microstructures.

In a general method of operation, a first fluid flows into the microstructure areas (e.g., divider microstructure rows) through the first inlets. Upper and lower boundaries of the first fluid flow into the cross flow channels (such as the feed pathways). Again, these cross flow channels are formed by the divider microstructures. Approximately half way along the length of the cross flow channels, feedthrough holes deliver a second fluid into the cross channels through the use of the continuous feed slots associated with the second inlets. When fluid one and two are immiscible, droplets of fluid develop where fluid exits the feedthrough holes (e.g., feed apertures). By engineering the flow rates and dimensions of the relevant elements of the two fluids, a size and volume fraction of the first and second fluids can be optimized for a particular application. The emulsification enters the emulsification outlet channels (e.g., outlets on opposite panel side from inlets) and eventually exits a side edge of the panel 102 at the emulsification outlets along the sides of the panel 102. When miscible fluids are delivered a mixture is created. To obtain this flow, a pressure of the fluid at the first inlets is ideally greater than a pressure at the panel outlets. Further, a pressure of second fluid needs to be greater than a pressure at the first inlets and less than the pressure of the panel outlets.

Figure 12:
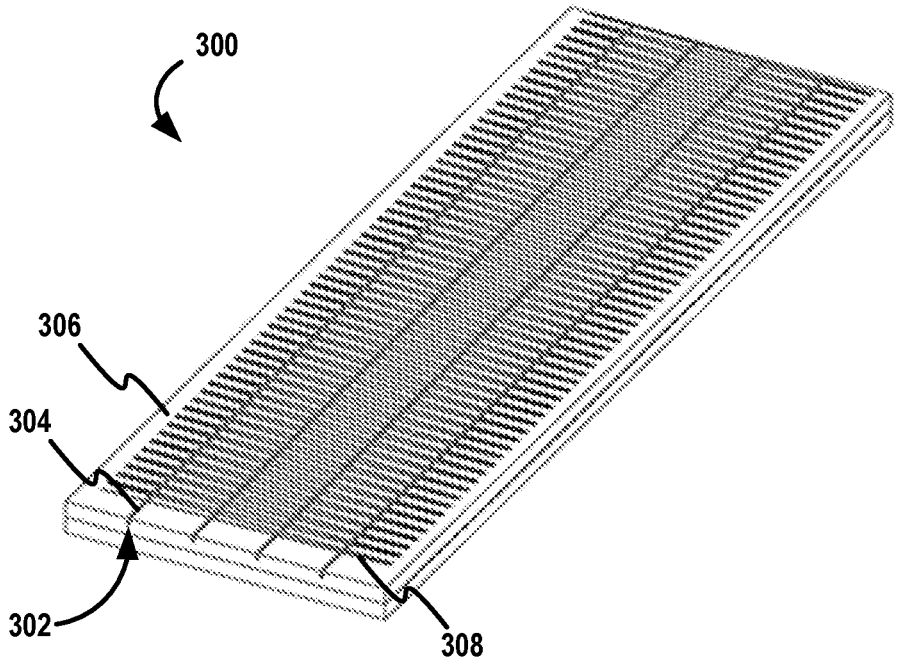
FIGS. 12-15B collectively illustrate another example panel that includes enlarged feed apertures and lateral apertures of raised features and divider microstructures.
Figure 13:
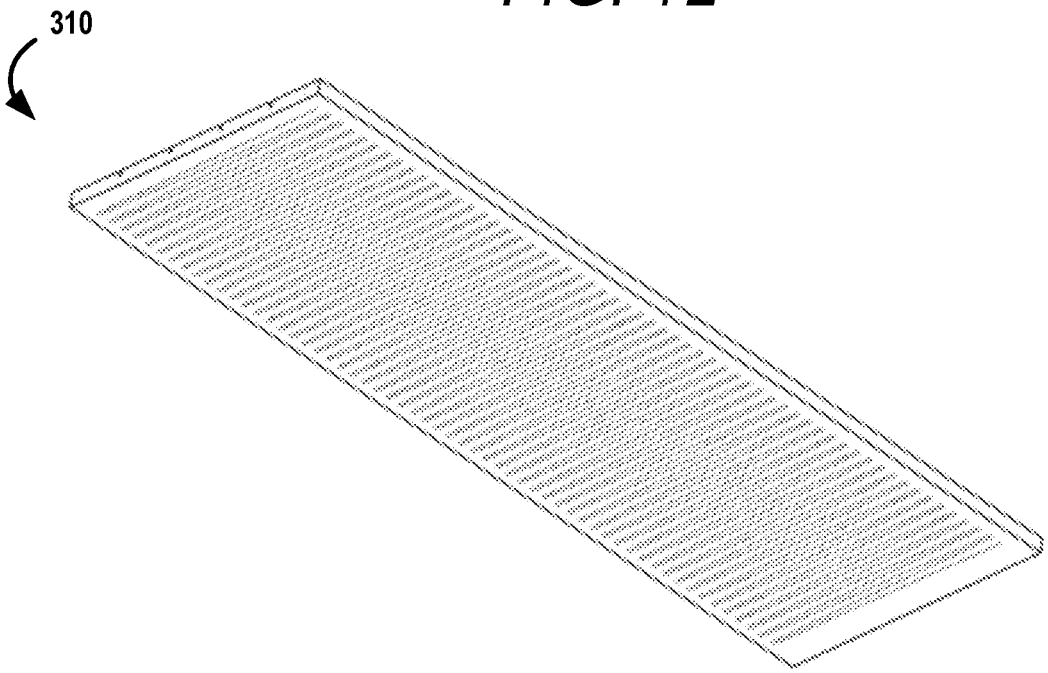

FIGS. 12 and 13 illustrate another example panel 300 that is identical in construction to the panel 102 of FIGS. 1-11 with the exception that the panel 300 comprises second inlets, such as second inlet 302 and continuous groove 304 that extend across the front surface 306 of the panel 300. These second inlets and continuous grooves effectively subdivide the zig-zag divider microstructure rows, such as divider microstructure row 308 into several sections. For example, divider microstructure row 308 is subdivided into five sections. The continuous grooves run the length of the panel 300 while the divider microstructure rows run the width of the panel 300.

A top cover 310 (see FIG. 13) is provided to cover the panel 300 and facilitate mixing of fluids across the panel 300.

Figure 14:
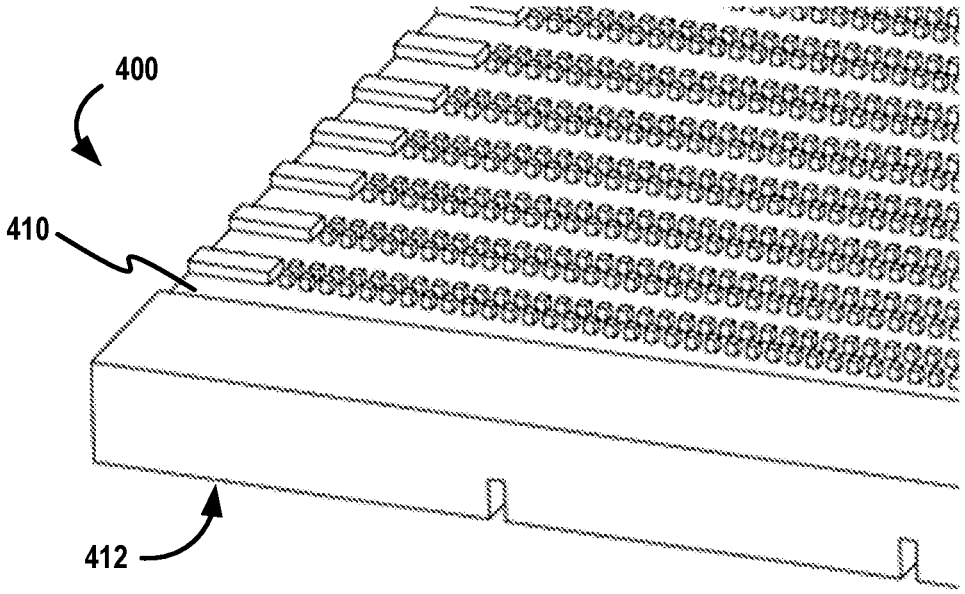
Figure 15A:
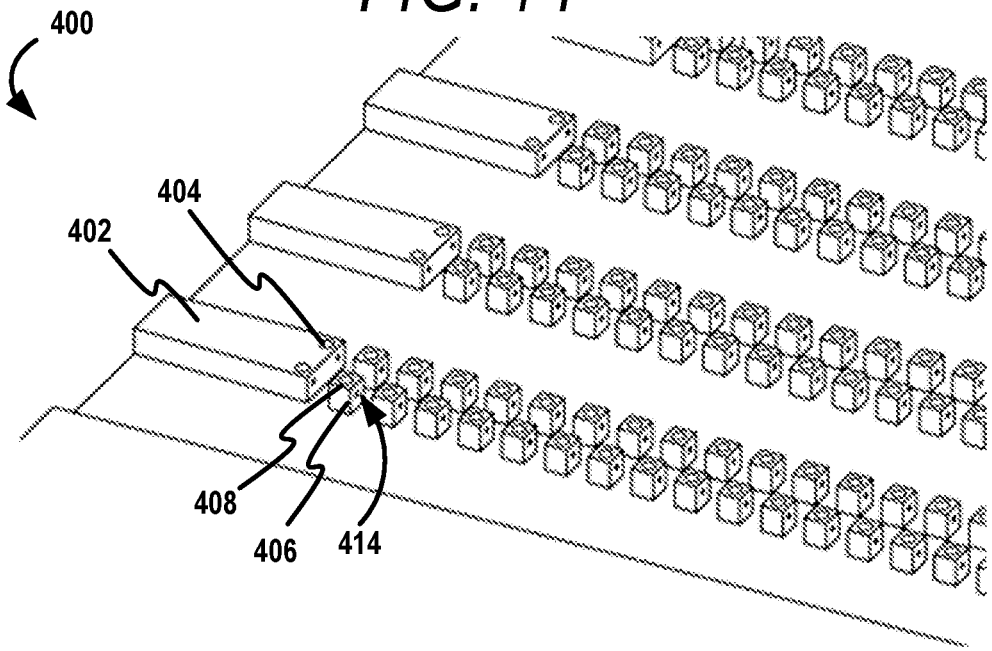
Figure 15B:
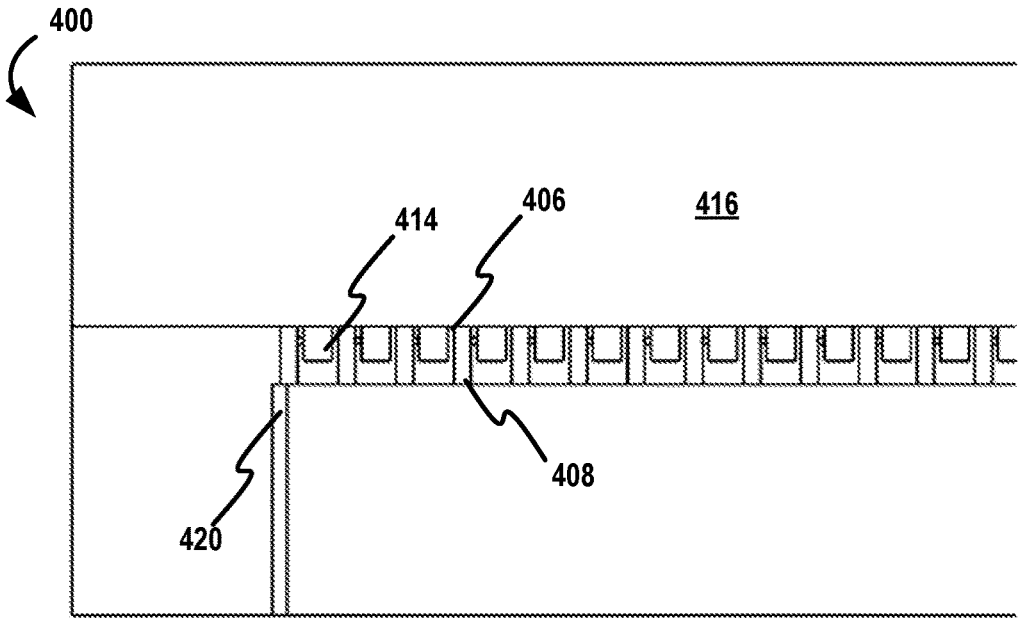

FIG. 14 illustrates a perspective view of another example panel 400 having drain holes, while FIG. 15A illustrates a close up view of the panel 400, while FIG. 15B illustrates a cross-sectional view of the panel 400. This example panel is identical to the panel 102 of FIGS. 1-10 with the exception that the panel 400 includes various enlarged feed apertures. For example, each of the raised features such as raised feature 402 that define the first inlets of the panel 400 comprise one or more feed apertures such as enlarged feed aperture 404. Each of the divider microstructures, such as divider microstructure 406 can also comprise an enlarged feed aperture 408. These enlarged feed apertures collectively function to allow for passage of a fluid from a second surface 412 of the panel 400 to a first surface 410 of the panel 400. This can include a first fluid, a second fluid, or a mixture thereof. The enlarged feed apertures provide a pathway of fluid communication from divider microstructure feed slots on the second surface 412, which are similar to the divider microstructure feed slots disclosed in embodiments above. In some embodiments, each of the raised features and/or divider microstructures, such as divider microstructure 406 can comprise lateral feed apertures, such as lateral feed aperture 414 (also referred to as a cross hole). These lateral feed apertures inject a fluid transferring through the enlarged feed apertures. In some embodiments, the enlarged feed apertures are covered or sealed to force fluid through only the lateral feed apertures. In operation, fluid ejected out of the lateral feed apertures will mix with fluid traveling between the divider microstructures. In one example a cover substrate 416 seals the enlarged feed aperture 408. A divider feed aperture 420 can also be utilized.

In general, the creation of enlarged feed apertures may be desired for some types of manufacturing processes where small feed apertures are difficult to create.

While two fluids have been disclosed as being mixable through the devices and apparatuses disclosed herein, it will be understood that when multiple panels are used, additional fluids can be mixed in at lower stages of a device that has multiple panels.

Figure 16:
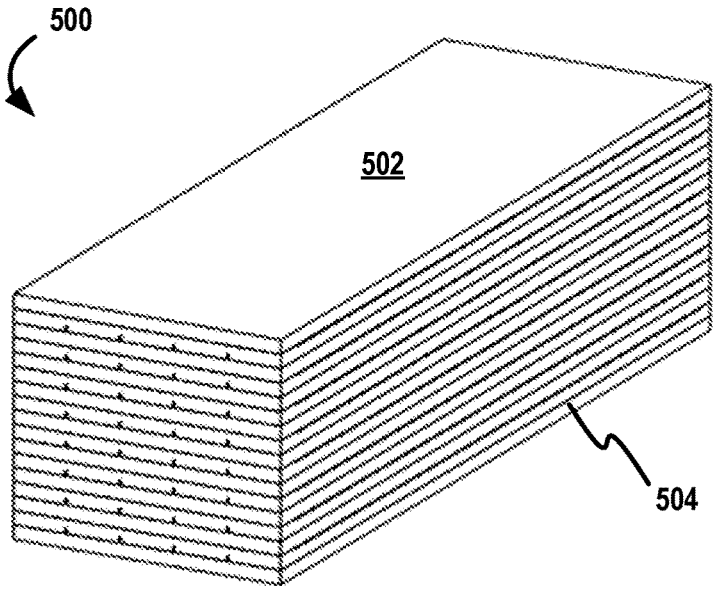
FIG. 16 illustrates an example panel device that includes a plurality of panels in a stacked array.

FIG. 16 illustrates an example stacked or layered emulsification device 500 that can be created by layering of a plurality of panels described herein. The emulsification device 500 can comprise a top panel 502 and bottom panel 504 that each include planar or flat (e.g., featureless) surfaces. A profiled surface that includes grooves or divider microstructures can be provided on either the top panel 502 and/or the bottom panel 504.

The above embodiments can be used for emulsification or mixing of two fluids with one another. In some embodiments, the emulsification can be created using both laminar and/or turbulent flow through the various panels.

Figure 17:
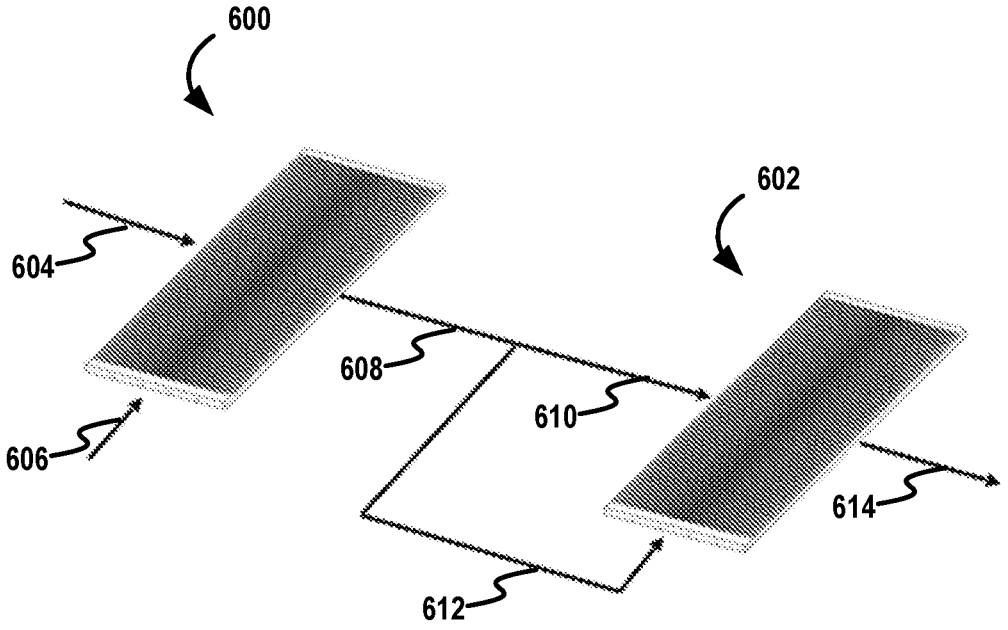
FIG. 17 is an exploded perspective view that illustrates two panels in a series arrangement.
Figure 18:
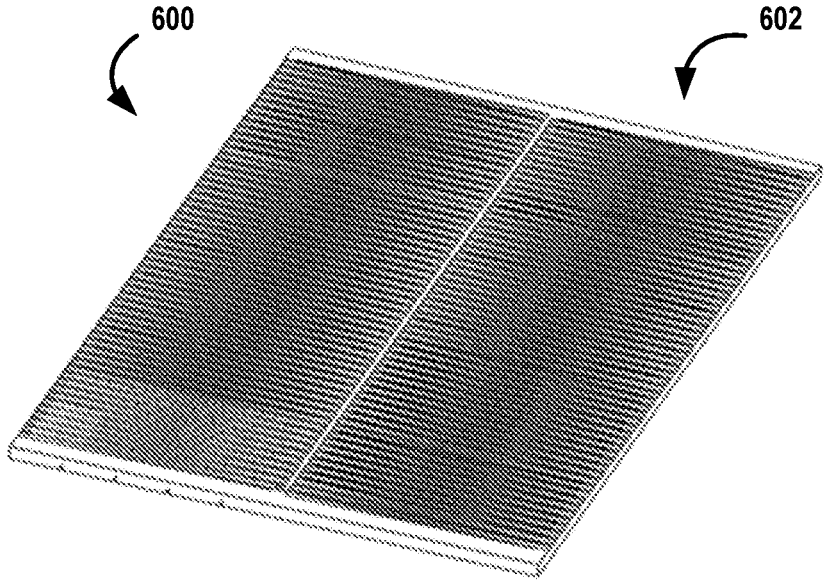
FIG. 18 is another perspective view illustrating the panels of FIG. 17 connected to one another in series.

FIG. 17 is a perspective view of two panels, which can comprise any of the panels of FIGS. 1-16. These two panels 600 and 602 are placed in series rather than stacked on one another. It will be understood that while the panels are illustrated for simplicity, the panels can include a complete device, such as the device 100 of FIG. 1 or the device 500 of FIG. 16 where top and bottom covers are utilized in combination with each of the panels 600 and 602. In some embodiments, a first fluid 604 is introduced over the the panel 600 and a second fluid 606 is also introduced over the panel 600. A mixture 608 of the first and second fluids exits the outlets of the panel 600. If the mixture produced by the panel 600 is not sufficiently mixed, the fluid can be introduced into the panel 602. For example, a first portion 610 of the mixture 608 is introduced into the first inlets of the panel 602. A second portion 612 of the mixture 608 is introduced to the second inlets of the panel 602. The resultant mixture 614 is a more thoroughly mixed composition of the first and second fluids than that which was output by panel 600. An assembled version of the two panels 600 and 602 is illustrated in FIG. 18. These two panels/mixing systems can be configured in series to increase the extent of the mixing. More than two panels could be put in series to increase the degree of mixing.

Figure 19:
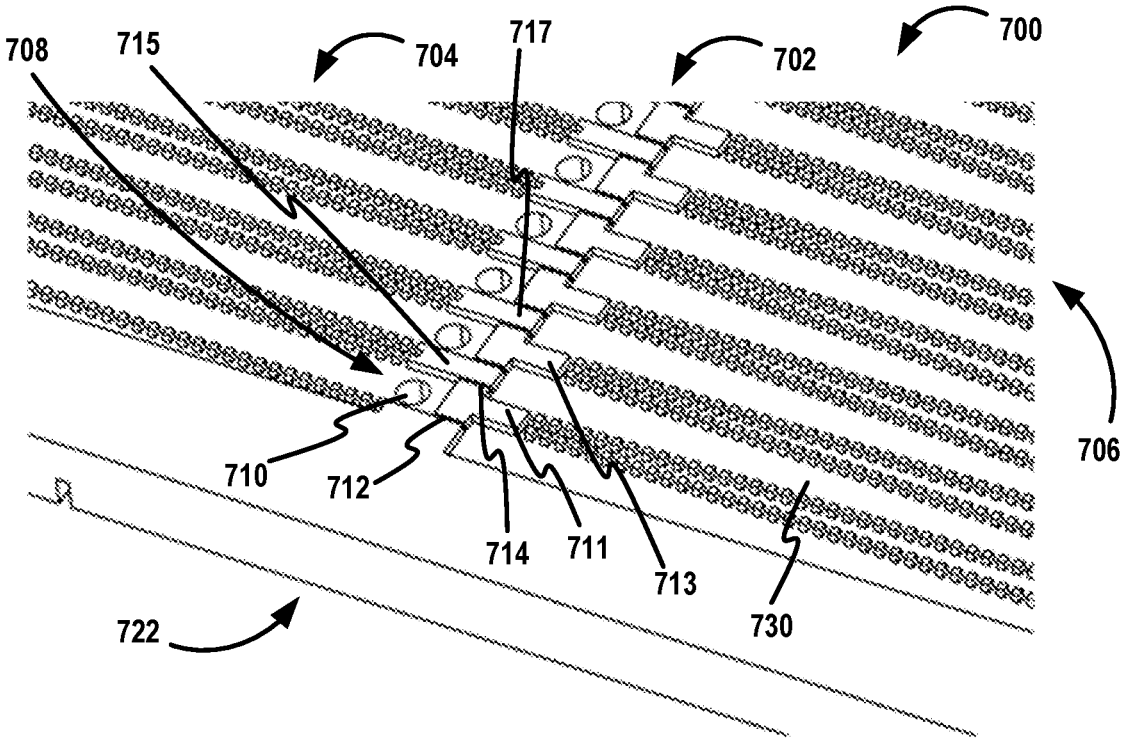
FIG. 19 is a perspective view of a portion of another example panel of the present disclosure that includes panel sections separated by a microstructure dam.

FIG. 19 illustrates another panel 700 that includes a mixing dam 702 that subdivides one section 704 of the panel from another section 706. For example, outlets 708 of the first section 704 can comprise a feed aperture 710 (e.g., aperture). The mixing dam 702 allows a portion of the fluid to pass from section 704 to section 706. The second section is referred to as a second stage of the panel 700. That is, fluid that does not pass through the feed apertures will pass through channels, such as channels 712 and 714 that are created when raised features 711 and 713 of the second section 706 interface with the raised features of the section 704, such as raised features 715 and 717. The fluid that passes through the feed apertures will pass to the second surface 722 of the panel. The interspaced connection between raised features on both the first and second sections forms the mixing dam 702.

Figure 20:
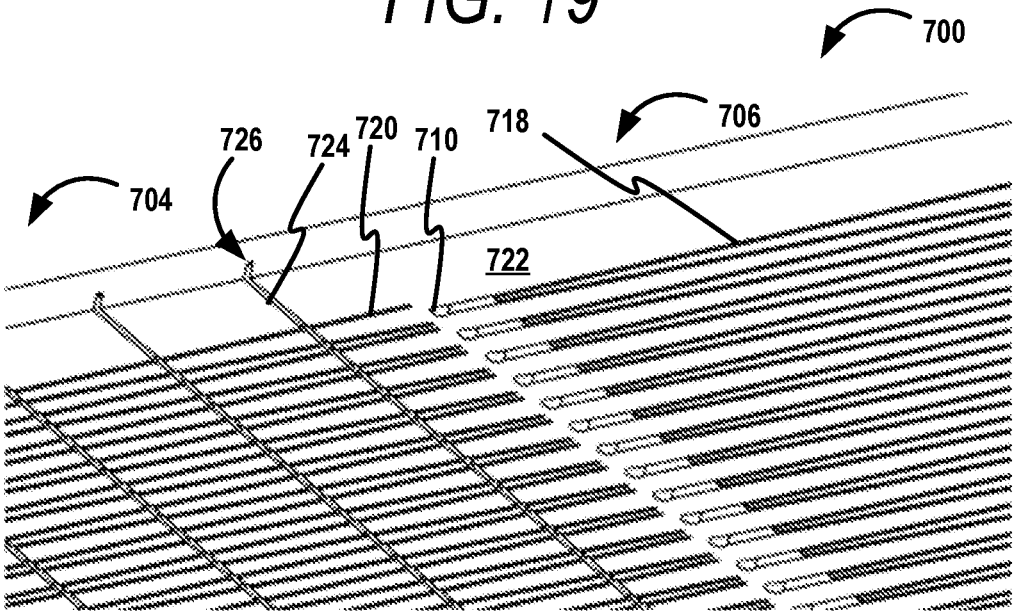
FIG. 20 is a bottom perspective view of the panel of FIG. 19.
Figure 21:
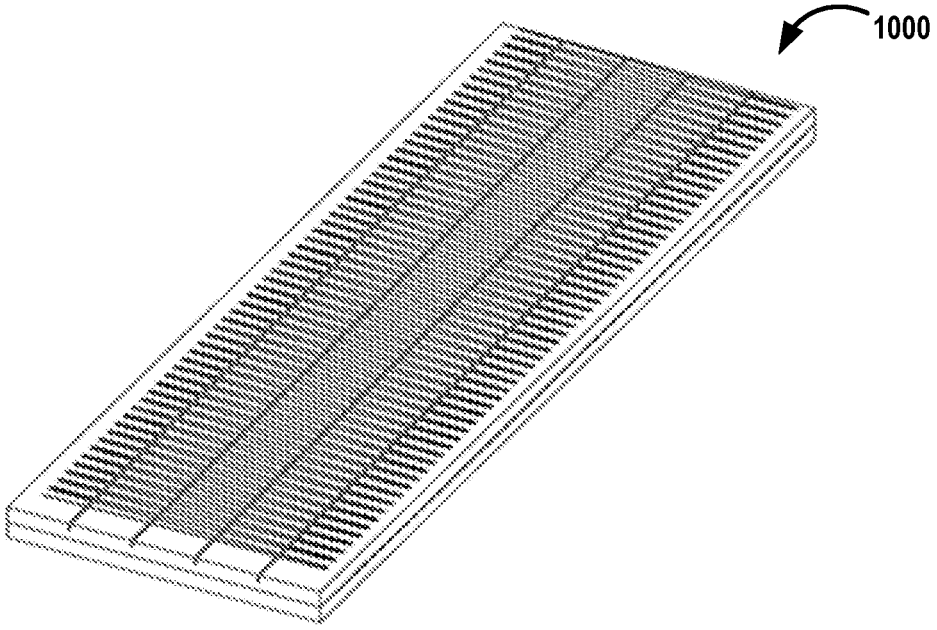
FIGS. 21-23B collectively illustrate another example panel device that includes feed apertures that are fed from above.
Figure 22:
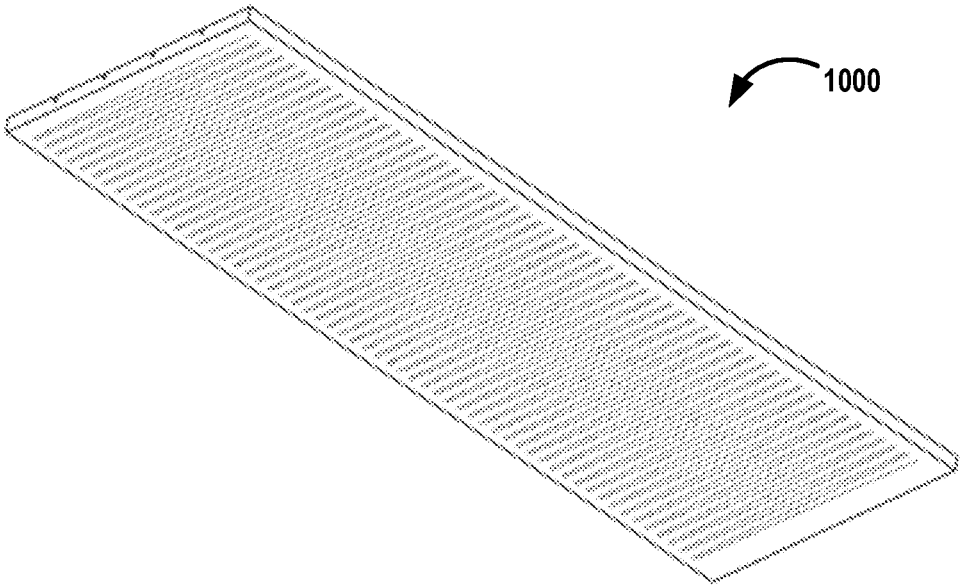
Figure 23A:
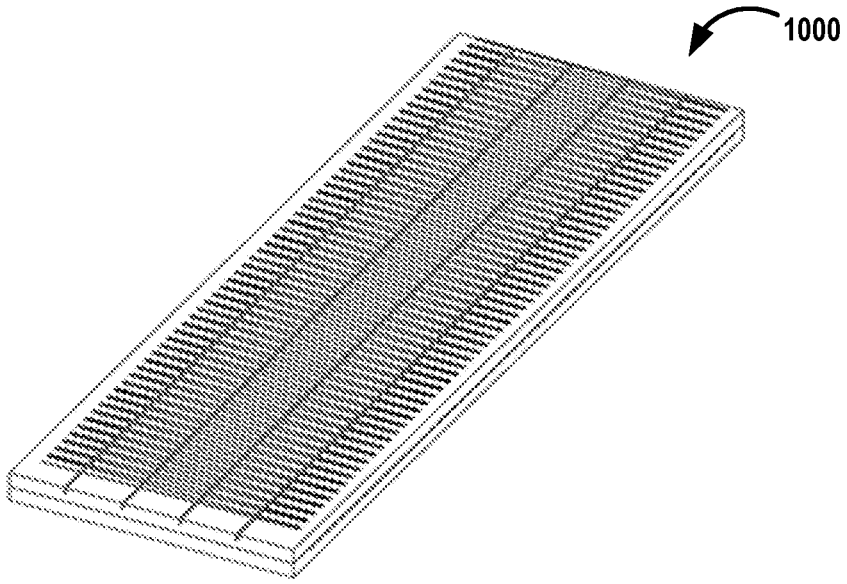
Figure 23B:
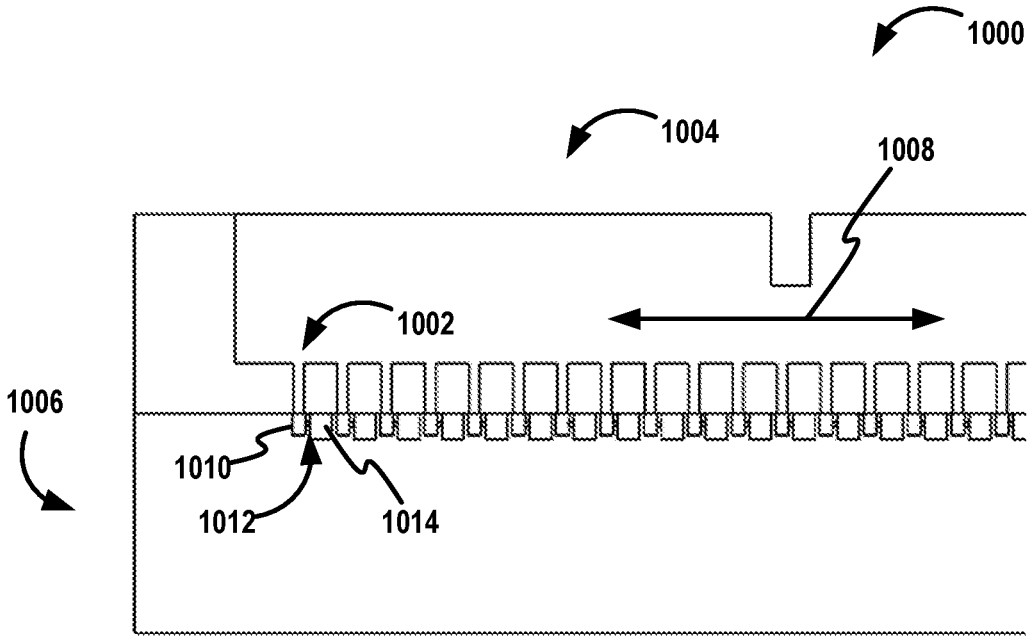

FIG. 20 is a reverse side of the panel 700 that comprises feed slots on both sections 704 and 706 of the panel. These feed slots do not connect with one another in some embodiments. That is feed slots 718 of panel section 704 do not connect to feed slots 720 of panel section 706. In some embodiments, continuous feed slots 724 coupled with second inlets 726 are present only in the second section 706 of the panel 700.

In operation, a portion of the flow that traverses across an upper surface of panel section 704 will enter the feed apertures 710 and pass through to a second surface 722 of the panel 700. That is, the feed apertures provide a pathway for fluid to pass under the mixing dam 702, from panel section 704 to panel section 706. This portion of the fluid will then travel through the feed slots 718 on the second surface 722 of the panel 700. In one embodiment, the feed apertures 710 pass underneath the mixing dam 702.

A second portion of the fluid will pass through the mixing dam 702 and onto a first surface 730 of the panel section 706. In some embodiment, approximately half the fluid provided to the panel section 704 will pass through the mixing dam 702, while approximately half of the fluid will pass through the feed apertures 710.

FIGS. 21-23B collectively illustrate another example panel configuration 1000. In this embodiment, the feed apertures, such as feed aperture 1002 are fed from a top panel 1004 rather than from through feed apertures in a main panel, such as main panel 1006. Thus, fluid travels through these panels differently from the fluid flow provided in the foregoing panels. In this embodiment, the feed aperture 1002 is fed through a divider microstructure feed slot 1008. A portion of the divider microstructure feed slot 1008 extends into a feature 1010 of the main panel 1006. A cross channel port 1012 is provided between feature 1010 and feature 1014.

Figure 24:
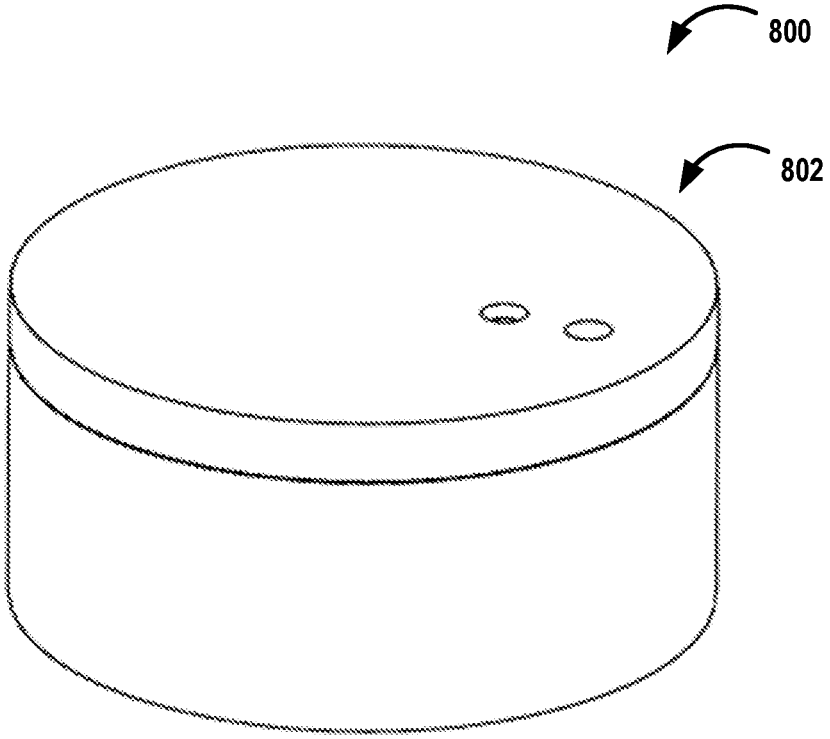
FIGS. 24-30 collectively illustrate a multi-channel mixing apparatus, constructed in accordance with the present disclosure, with FIGS. 27-30 illustrating an example mixing disk.
Figure 25:
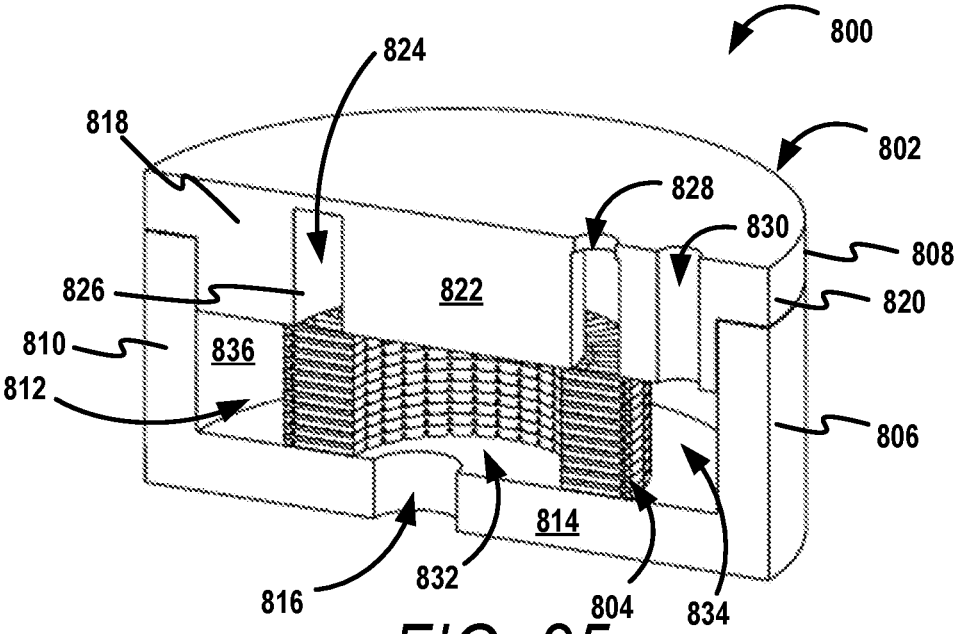
Figure 26:
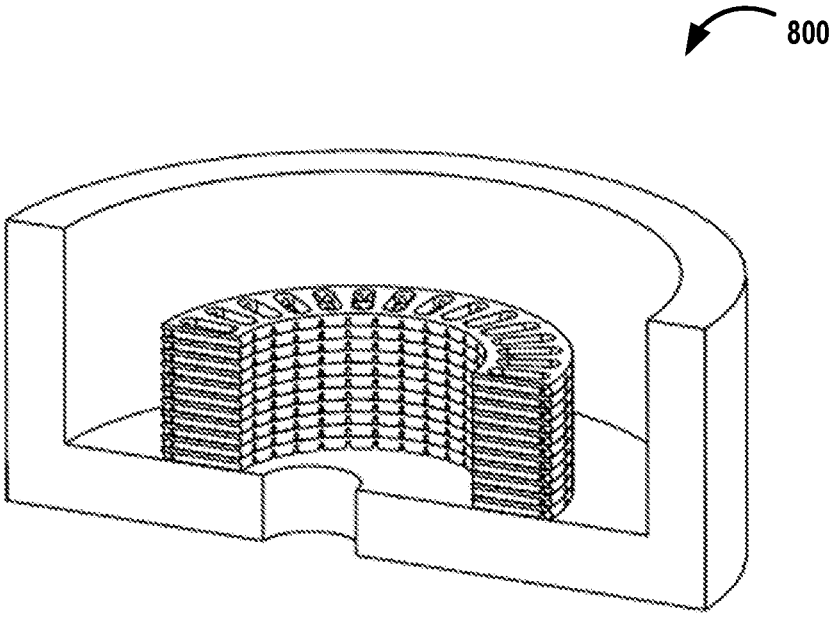

FIGS. 24-26 illustrate an example multi-stage or multi-channel mixing device 800. The device comprises a housing sub-assembly (referred to herein as housing 802) and a mixer sub-assembly 804 (comprising a stack a mixing plates described below). In general, the device housing 802 comprises a tubular portion 806 and a cover portion 808. In some embodiments, the tubular portion 806 comprises an upper sidewall 810 that forms a cavity 812 when enclosed by a lower sidewall 814 comprising an outlet 816.

The cover portion 808 is generally configured to mate with the tubular portion 806. The cover portion 808 comprises a body portion 818 that include a flange 820. The flange 820 mates with an upper surface of the tubular portion 806. The body portion 818 comprises a plug 822 surrounded concentrically by an annular spacing (referred to as a first inlet plenum 824) formed between an outer sidewall of the plug 822 and an inner sidewall 826 of the cover portion 808.

In various embodiments, the cover portion 808 comprises a first inlet 828 and a second inlet 830. When the cover portion 808 is joined to the tubular portion 806 as in FIG. 25, the plug 822 seals an output plenum 832 of the mixer-sub assembly 804. The first inlet 828 is disposed directly over an upper end of the mixer sub-assembly 804. The second inlet is located over a second inlet plenum 834 that includes an annular spacing between an outer periphery of the mixer-sub assembly 804 and an inner surface 836 of the upper sidewall 810 of the tubular portion 806.

A first fluid introduced into the first inlet plenum 824 through the first inlet 828. A second fluid can be introduced into the second inlet plenum 834 through the second inlet 830. As noted above, the first and second fluids can be the same or different fluids. The fluid can be a liquid and/or a gas in some embodiments.

In some embodiments, the mixer sub-assembly 804804 comprises a plurality of mixing plates stacked together to form the output plenum 832. As noted above, the mixer sub-assembly 804 is positioned within the tubular portion 806 so as to form the second inlet plenum 834 between an outer periphery of the mixer sub-assembly 804 and an inner sidewall of the tubular portion.

Figure 27:
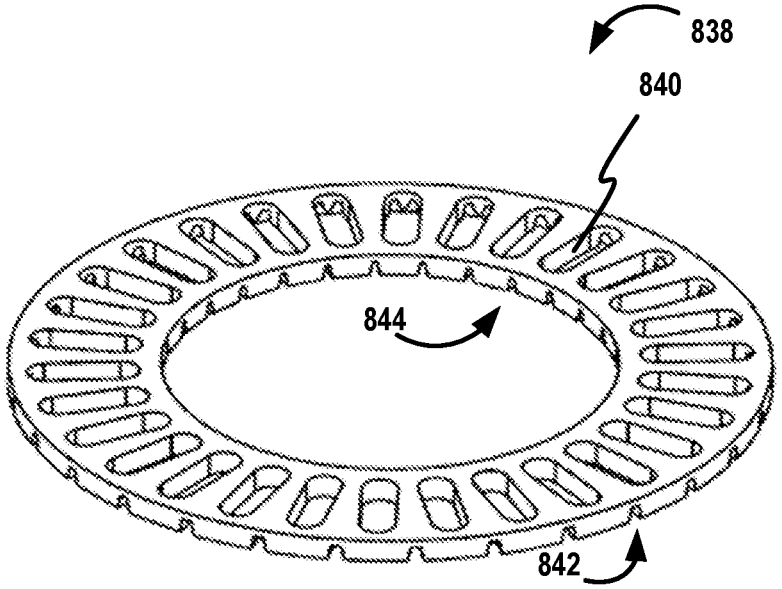
Figure 28:
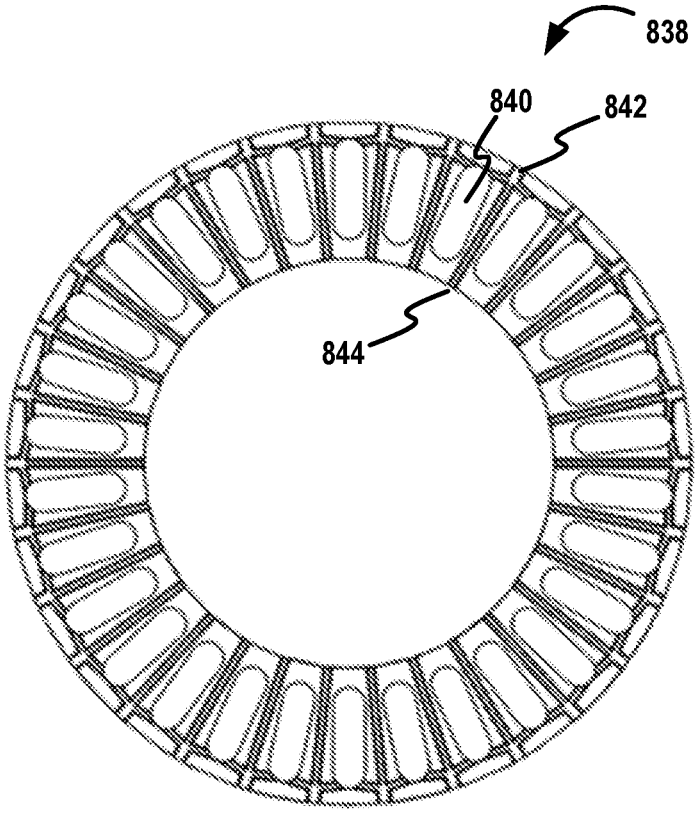

FIGS. 26-28 collectively illustrate various views of an example mixing plate 838 that can be utilized in the mixer sub-assembly 804. The mixing plate 838 is a disk that comprises a plurality of plenum slots such as plenum slot 840. The mixing plate 838 also comprises a plurality of inlet notches such as inlet notch 842 and outlet notches, such as outlet notch 844. The outlet notches are positioned on the output plenum side, whereas the inlet notches are positioned on the second inlet plenum side, which allows for mixing of the first and second fluid through the mixer sub-assembly 804 as will be described in greater detail below.

Figure 29:
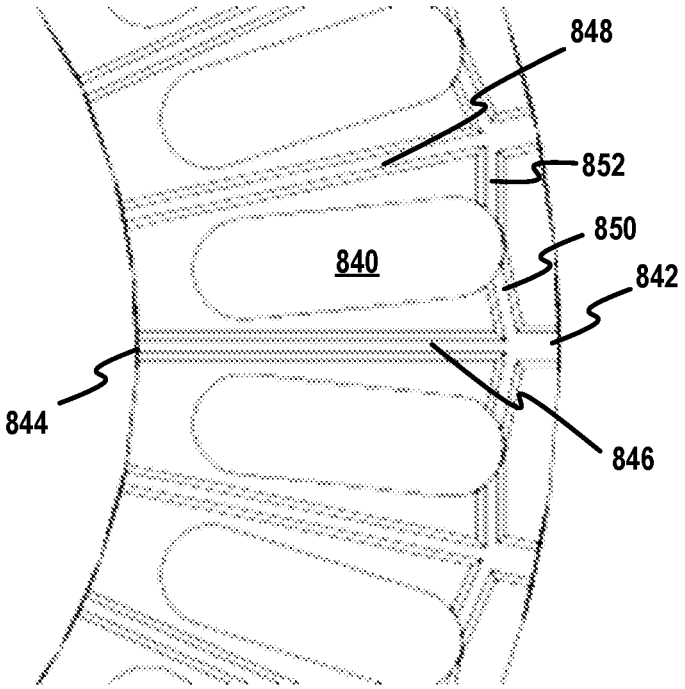

An underside of the mixing plate 838 is illustrated in FIG. 28. In FIG. 29, a close up view of a portion of the underside of the mixing plate 838 is illustrated. A plurality of mixing channels are formed around each of the plenum slots such as plenum slot 840. In one embodiment the plenum slot 840 is separated from adjacent plenum slots by mixing channels 846 and 848. Each mixing channel also comprises cross channels 850 and 852 that couple a mixing channel, such as mixing channel 846 to adjacent plenum slots.

Figure 30:
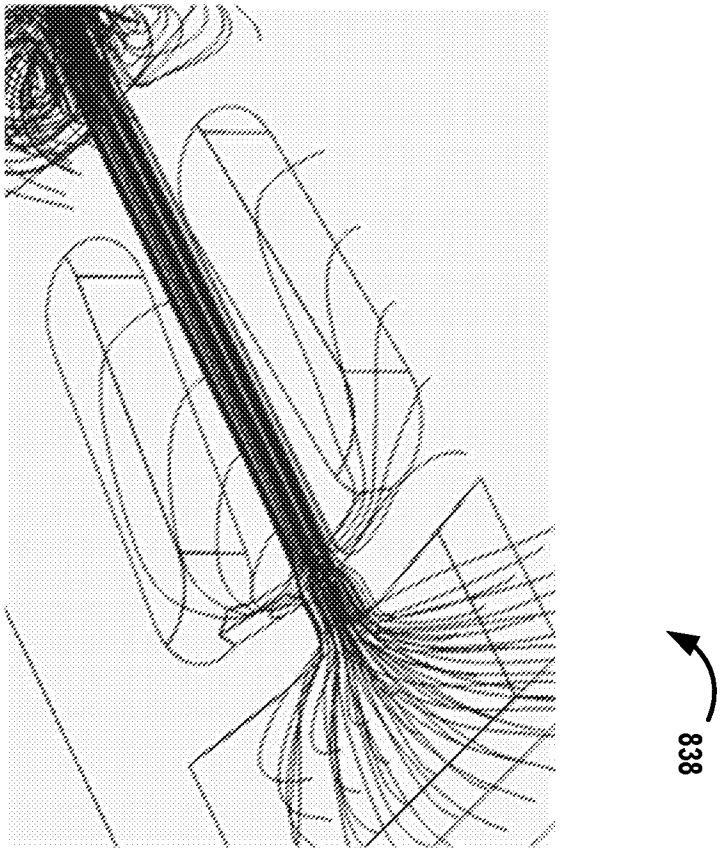

In operation, and referring collectively to FIGS. 24-26, a first fluid is flowed through the first inlet 828. This fluid is directed into the plenum slots of the mixer sub-assembly 804. A second fluid is then flowed into the second inlet 830 and into the second inlet plenum 834. The second fluid will enter the inlet notches (such as inlet notch 842) of the mixer sub-assembly 804 and travel into the mixing channel 846. The first fluid will be drawn into mixing channel 846 through the cross channel 850 to mix with the second fluid and exit through the outlet notch 844. Mixed fluid will exit the mixer sub-assembly 804 into output plenum 832 and ultimately out of the outlet 816 (see FIG. 25). FIG. 30 illustrates flow of fluids through a portion of the mixing plate 838.

With high flow rates the flow can become turbulent as the fluid exits the mixing channel into the outlet plenum. Turbulence at this point in the flow path increases an amount of mixing but it is less consistent (mixing consistency and not consistency of the fraction of the first and second fluids) from one mixing channel to another. In many mixing applications mixing consistency is not important. In these cases the device would more than likely be engineered with turbulent flow. Where consistent mixing is important one would engineer the system without turbulent flow. Stated otherwise, for low flow rates the entire flow path would behave in a laminar manner. Even with high flow rates most of the plenum slots and mixing channels will be laminar in nature. The area of separated flow is where turbulent conditions might first develop. Turbulence enhances mixing in some embodiments if immiscible fluids are used an emulsion would be created.

Figure 31:
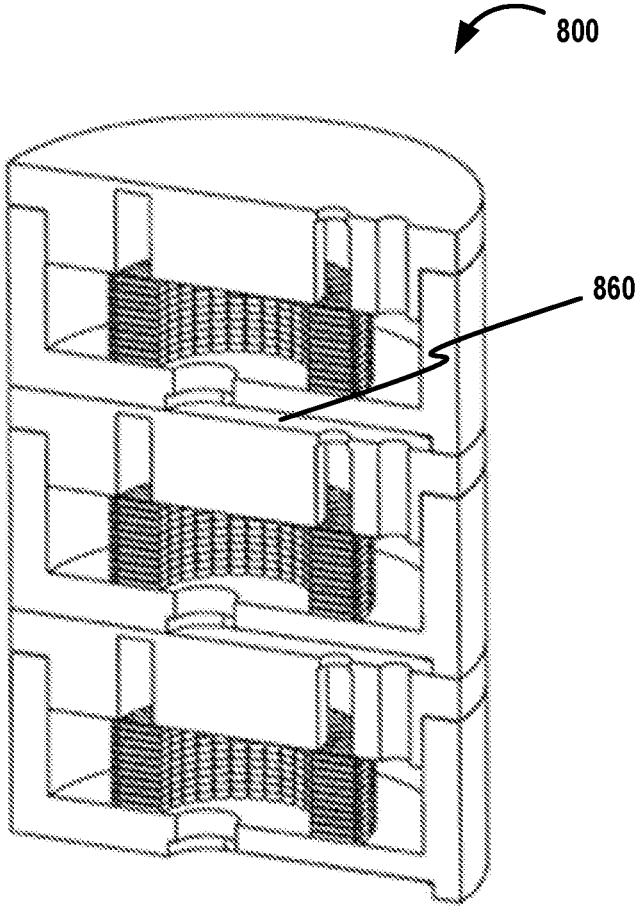
FIG. 31 is another example mixing apparatus comprised of a plurality of multi-channel mixing apparatuses.

FIG. 31 illustrates an example multi-stage mixing device constructed from a plurality of the devices 800 of FIGS. 24-29. In this instance, a space or notch 860 is formed into a lower surface of a portion of the devices to provide a fluid pathway from an outlet of one device to the first and second inlets of another lower positioned device.

Figure 32:
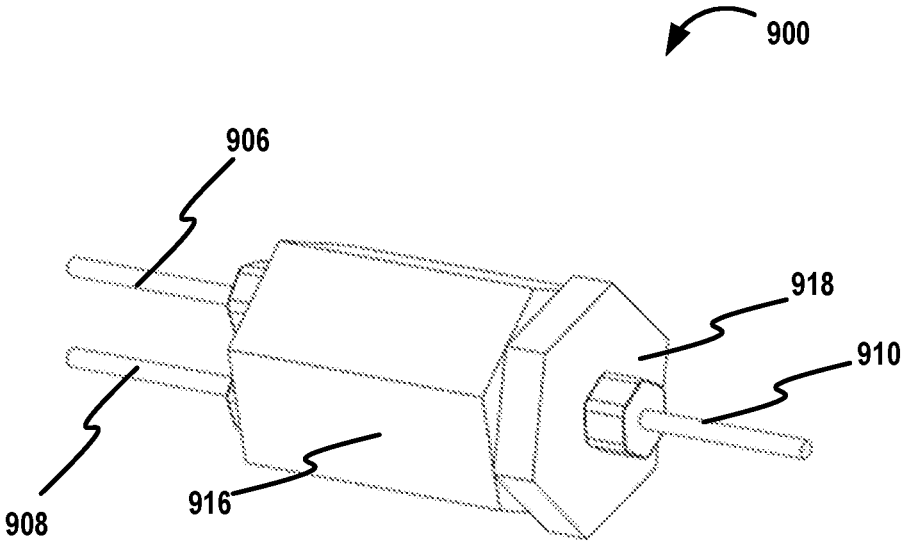
FIG. 32 is a perspective view of an example fluid mixing device.
Figure 33:
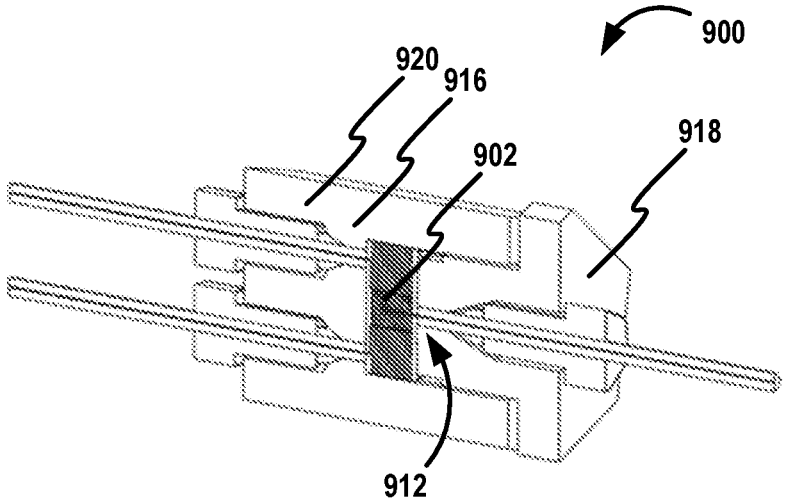
FIG. 33 is a cross section of the device of FIG. 32.
Figure 37:
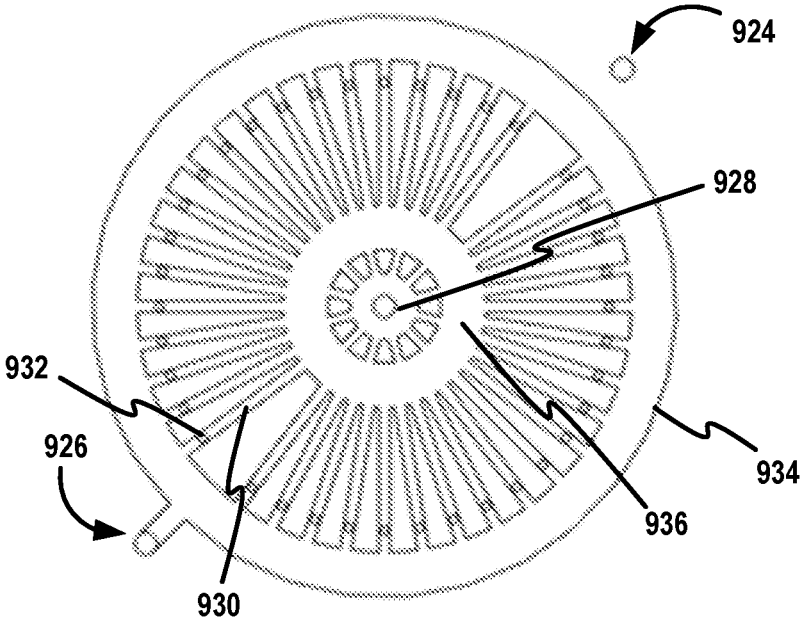
FIG. 37 is a plan view of an example mixing plate of the assembly of FIG. 35.

FIGS. 32 and 33 illustrates an example apparatus 900 that comprises a mixing assembly 902 that comprises a plurality of mixing plates such as mixing plate 904 (see FIG. 37). The apparatus 900 comprises a first inlet 906 and second inlet 908. These inlets interface with opposing sides of the mixing assembly 902. An outlet tube 910 is position near an outlet 912 of the mixing assembly 902. In some embodiments, the mixing assembly 902 is enclosed in a housing 916. The housing 916 can be a two-part embodiment with a threaded plug 918 and tubular receiver 920. The first inlet 906 and second inlet 908 are associated with the tubular receiver 920.

Figure 34:
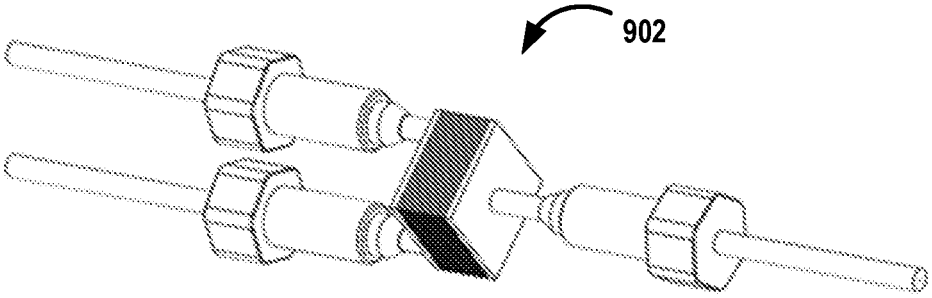
FIG. 34 is a perspective view of the device of FIG. 32 without a housing.

FIG. 34 illustrates the mixing assembly 902 without the housing 916 of the apparatus 900.

Figure 35:
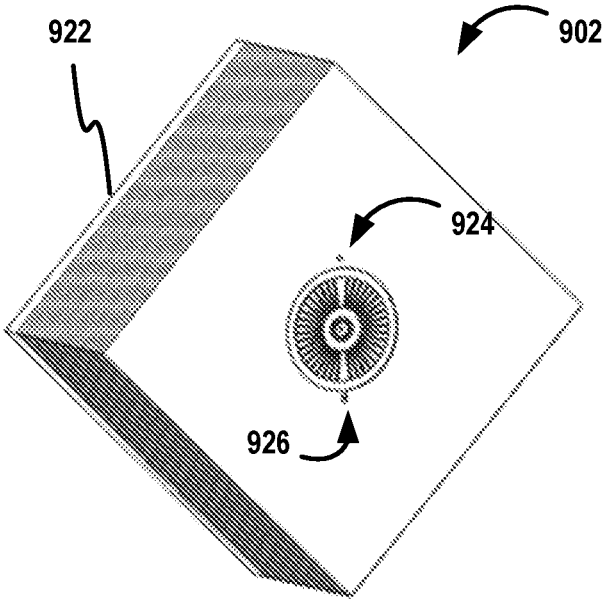
FIG. 35 is a perspective view of an example mixing assembly having a plurality of mixing plates.
Figure 36:
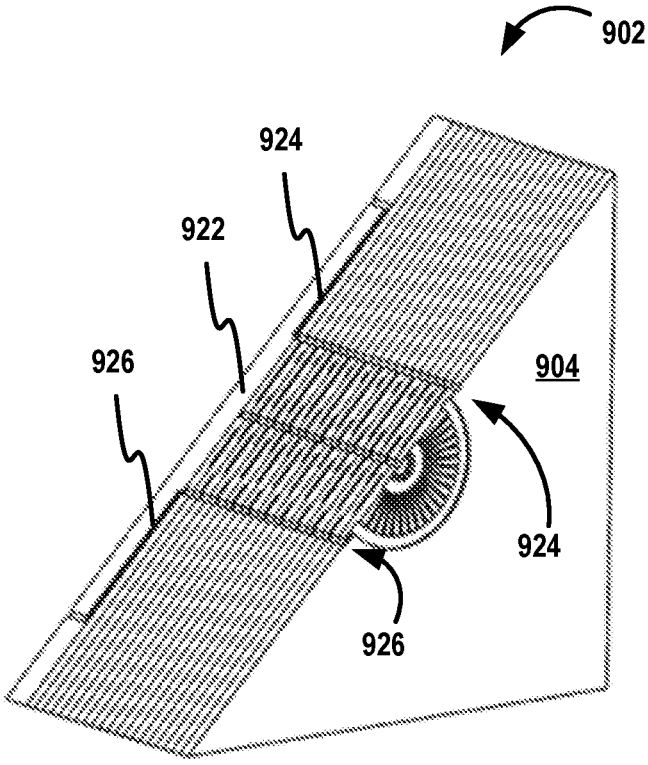
FIG. 36 is a cross sectional view of FIG. 35.

FIGS. 35 and 36 illustrate the mixing assembly 902 with a plurality of mixing plates, such as mixing plate 904 that are coupled to an input plate 922. A bypass aperture 924 extends through the mixing assembly and receives a fluid from the first inlet 906 (FIGS. 32 and 33). This bypass aperture 924 is a pass through feature with respect to mixing plate 904 with no direct input into mixing channels of the mixing plate 904, but instead delivers fluid to a second mixing plate 940 described below with reference to FIGS. 39 and 40. The second mixing plate 940 is positioned behind the mixing plate 904. Thus, the mixing plate 904 and mixing plate 940 work cooperatively to mix fluids.

A second inlet aperture 926 extends through the mixing assembly and receives a fluid from the second inlet 908 (FIGS. 32 and 33). This second inlet aperture 926 feeds a fluid directly into the mixing channels of the mixing plate 904.

An outlet aperture 928 extends through each of the mixing plates but does not extend through the input plate 922. In some embodiments, fluids entering the mixing plate 904 will mix when passed through the mixing channels of the mixing plate 904. Once mixed the mixed fluid will exit through the outlet aperture 928.

Figure 38:
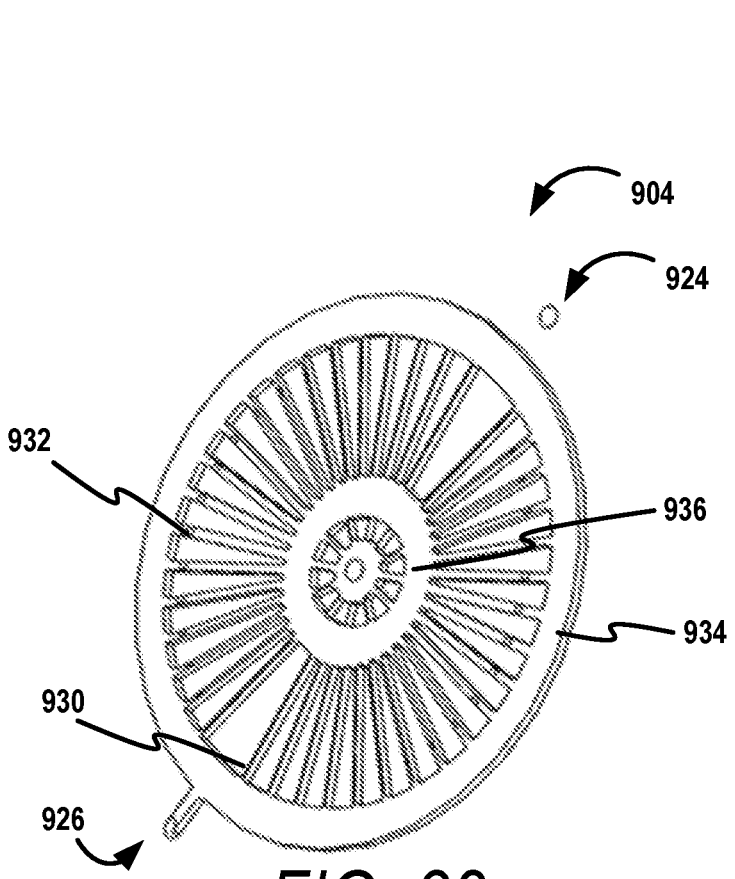
FIG. 38 is a perspective view of the mixing plate of FIG. 37.

FIGS. 37-38 collectively illustrate a close up view of the mixing plate 904, illustrating mixing features in greater detail. A fluid will enter mixing channels, such as mixing channel 930, through the second inlet aperture 926.

A fluid (which could comprise a second or different fluid) will flow into the plurality of mixing channels by entering through mixing channel inlets, such as mixing channel feed aperture 932. This fluid passes through from a backside of a mixing plate and into the mixing channel 930 via the mixing channel feed apertures 932. This fluid transfer is facilitated using a second mixing plate 940 (again, see FIGS. 39 and 40) which is positioned behind the mixing plate 904.

The first fluid enters the mixing channel inlets from underneath the mixing plate 904. A second fluid will also enter the mixing channel through the second inlet aperture 926. A boundary plenum 934 encircles the mixing channels and the second inlet aperture. The two fluids mix within the mixing channels. Each of the mixing channels converges at an output plenum 936 that funnels into the outlet 912 of the mixing assembly 902.

In operation, the second fluid is fed to the mixing channels from a second plenum created by the boundary plenum 934. The plenum feeds the mixing channels at near equal pressure, which yields generally equal flow at all of the mixing channels. The inlet apertures supply the first fluid to the mixing channels. At this junction the fluids mix. Depending on the fluids, additional mixing may occur in the mixing channels. The mixed fluid flow into the outlet plenum and out the outlet 912 of the mixing assembly 902. In some embodiments, spacers are placed between adjacent mixing plates to allow for fluid to flow between adjacent plates.

Figure 39:
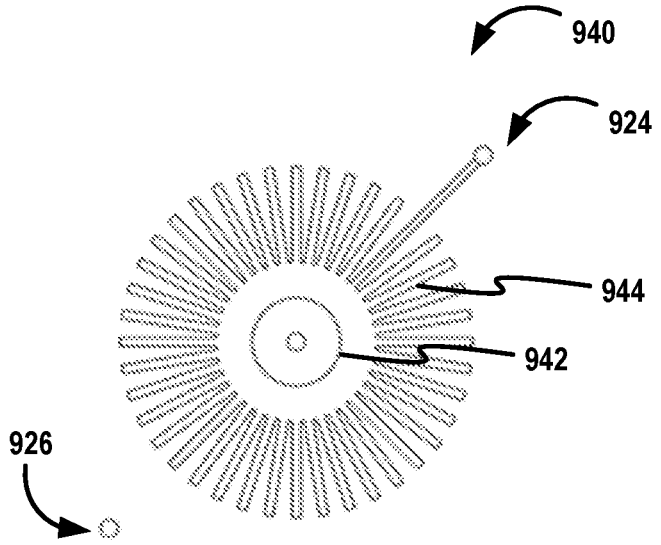
FIG. 39 is a plan view of another example mixing plate.
Figure 40:
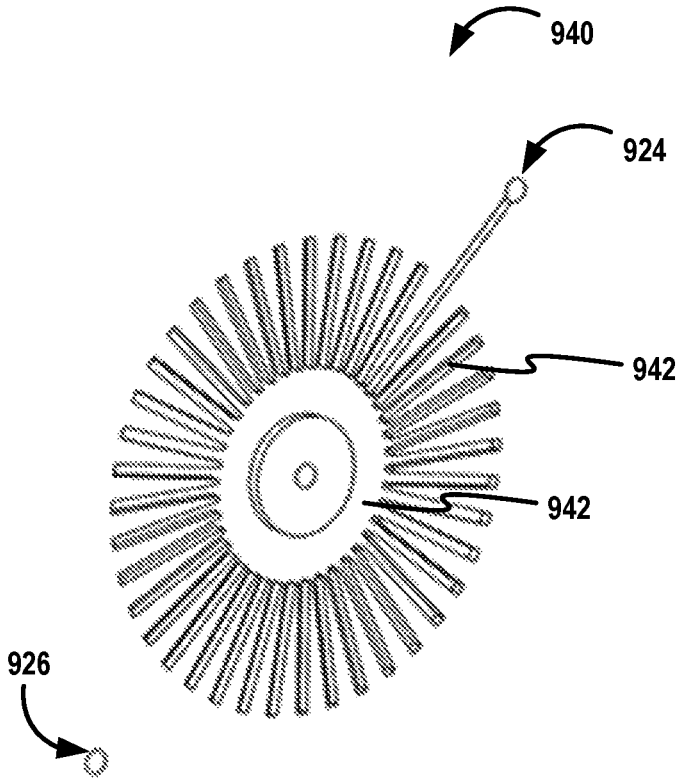
FIG. 40 is a perspective view of the mixing plate of FIG. 39.

The mixing plate 940 is illustrated in FIGS. 39 and 40, which is utilized in combination with the mixing plate 904 of FIGS. 37-39. This mixing plate 940 also comprises an interior plenum 942 that isolates a portion of one or more fluids flowing across the mixing plate 940 from other fluids flowing across the mixing plate 940. Again, fluid that flows through the bypass aperture 924 will fill a plurality of feeder slots, such as feeder slot 944 that align with the mixing channels 930 of mixing plate 904.

FIG. 40 also illustrates yet another view of the mixing plate 904. The plates 904 and 940 cooperate together such that the mixing plate 940 delivers fluid to a backside of mixing plate 904 when in stacked or layer relationship. The fluid delivered by mixing plate 940 to mixing plate 904 is provided at the central rounded holes (mixing channel feed apertures 932 of FIG. 37) of the mixing plate 904. In contrast with the mixing plate 904, the second mixing plate 940 comprises the second inlet aperture 926, but the second inlet aperture 926 functions as a bypass with respect to the second mixing plate 940.

The mixing assemblies such as mixing assembly 902 can be utilized to mix immiscible fluids into an emulsification. The size of the cross, mixing and mixed fluid channels would affect the size of emulsification droplet. The mixing assemblies can be used to mix immiscible fluids into an emulsification. The size of the cross, mixing and mixed fluid channels would affect the size of emulsification droplet.

The mixing assemblies can be used to mix of fuels and air for an engine, food products, paint, adhesives, immiscible fluids, fluids, cosmetic fluids, fluids for chromatography and so forth.

In many mixing applications a chemical reaction(s) takes place. In many of these cases heat is either given off or absorbed as a result of the reaction(s). Because the mixing areas are small, heat transfer from the fluid to the surfaces of the mixing assembly can be accurately controlled by the flow rates and the material properties of the mixing assembly components. This is another advantage of the disclosed mixing systems herein.

Advantages of these mixing devices include, but are not limited to, including plenums that supply fluids at equal rates to all of the mixing areas. The mixing ratio of the input fluids is equal in some embodiments that results in even mixing throughout the entire output. The mixing area is supplied by two cross channels, and double mixing rates are provided when if only one side was supplied. The output plenum contributes to equal flow rates of the mixing areas and mixing channels. A radial orientation of the mixing areas enhances mixing and allows for stacked layers of mixing areas and related channels.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the present disclosure in the form disclosed. Many modifications and variations will be apparent to those of ordinary skill in the art without departing from the scope and spirit of the present disclosure. Exemplary embodiments were chosen and described in order to best explain the principles of the present disclosure and its practical application, and to enable others of ordinary skill in the art to understand the present disclosure for various embodiments with various modifications as are suited to the particular use contemplated.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

The terminology used herein is for the purpose of describing particular embodiments only and is not intended to be limiting of the technology. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that like or analogous elements and/or components, referred to herein, may be identified throughout the drawings with like reference characters. It will be further understood that several of the figures are merely schematic representations of the present disclosure. As such, some of the components may have been distorted from their actual scale for pictorial clarity.

The flowchart and block diagrams in the Figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function (s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

In the following description, for purposes of explanation and not limitation, specific details are set forth, such as particular embodiments, procedures, techniques, etc. in order to provide a thorough understanding of the present invention. However, it will be apparent to one skilled in the art that the present invention may be practiced in other embodiments that depart from these specific details.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" or "according to one embodiment" (or other phrases having similar import) at various places throughout this specification are not necessarily all referring to the same embodiment. Furthermore, the particular features, structures, or characteristics may be combined in any suitable manner in one or more embodiments. Furthermore, depending on the context of discussion herein, a singular term may include its plural forms and a plural term may include its singular form. Similarly, a hyphenated term (e.g., "on-demand") may be occasionally interchangeably used with its non-hyphenated version (e.g., "on demand"), a capitalized entry (e.g., "Software") may be interchangeably used with its non-capitalized version (e.g., "software"), a plural term may be indicated with or without an apostrophe (e.g., PE's or PEs), and an italicized term (e.g., "$N+1$") may be interchangeably used with its non-italicized version (e.g., "N+1"). Such occasional interchangeable uses shall not be considered inconsistent with each other.

Also, some embodiments may be described in terms of "means for" performing a task or set of tasks. It will be understood that a "means for" may be expressed herein in terms of a structure, such as a processor, a memory, an I/O device such as a camera, or combinations thereof. Alternatively, the "means for" may include an algorithm that is descriptive of a function or method step, while in yet other embodiments the "means for" is expressed in terms of a mathematical formula, prose, or as a flow chart or signal diagram.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It is noted at the outset that the terms "coupled," "connected", "connecting," "electrically connected," etc., are used interchangeably herein to generally refer to the condition of being electrically/electronically connected. Similarly, a first entity is considered to be in "communication" with a second entity (or entities) when the first entity electrically sends and/or receives (whether through wireline or wireless means) information signals (whether containing data information or non-data/control information) to the second entity regardless of the type (analog or digital) of those signals. It is further noted that various figures (including component diagrams) shown and discussed herein are for illustrative purpose only, and are not drawn to scale.

While specific embodiments of, and examples for, the system are described above for illustrative purposes, various equivalent modifications are possible within the scope of the system, as those skilled in the relevant art will recognize. For example, while processes or steps are presented in a given order, alternative embodiments may perform routines having steps in a different order, and some processes or steps may be deleted, moved, added, subdivided, combined, and/or modified to provide alternative or sub-combinations. Each of these processes or steps may be implemented in a variety of different ways. Also, while processes or steps are at times shown as being performed in series, these processes or steps may instead be performed in parallel, or may be performed at different times.

While various embodiments have been described above, it should be understood that they have been presented by way of example only, and not limitation. The descriptions are not intended to limit the scope of the invention to the particular forms set forth herein. To the contrary, the present descriptions are intended to cover such alternatives, modifications, and equivalents as may be included within the spirit and scope of the invention as defined by the appended claims and otherwise appreciated by one of ordinary skill in the art. Thus, the breadth and scope of a preferred embodiment should not be limited by any of the above-described exemplary embodiments.

What is claimed is:

1. A device, comprising:

a first panel;

a first plurality of raised features extending from a first surface of the first panel, the first plurality of raised features being spaced apart from one another and disposed at an end of one edge of the first panel to form first inlets;

a second plurality of raised features extending from the first surface of the first panel, the second plurality of raised features being spaced apart from one another and disposed at an end of a second edge of the first panel to form outlets;

a plurality of divider microstructures extending from the first surface of the first panel in line with and in between the first plurality of raised features and the second plurality of raised features, wherein at least a portion of adjacent divider microstructures are spaced apart to form feed pathways; and second inlets that provide pathways for communication of fluid from a second surface to the first surface through feed apertures extending from the feed pathways to the first surface, the pathways providing fluid in a direction that is orthogonal to the feed pathways of fluid communication of the first inlets, wherein the second inlets extend across the first panel to form continuous divider microstructure feed slots that align with the plurality of divider microstructures on the first surface.

2. The device according to claim 1, wherein the plurality of divider microstructures are arranged into rows, wherein each of the first plurality of raised features is associated with a pair of the rows.

3. The device according to claim 2, wherein the plurality of divider microstructures diverge from one another forming a substantially v-shaped outlet channel.

4. The device according to claim 3, wherein each of the pair of the rows is associated with a different one of the second plurality of raised features.

5. The device according to claim 4, further comprising a second panel disposed coupled in series with the first panel, the second panel being identical to the first panel, wherein a first fluid is passed through the first inlets of the first panel and a second fluid is passed through the second inlets of the first panel, further wherein a mixture of the first fluid and the second fluid exiting the outlets of the first panel are directed into both the first inlets of the second panel and the second inlets of the second panel to further mix the mixture.

6. The device according to claim 5, wherein a first section of the first panel and second section of the first panel are separated by a dam to prevent the mixture from crossing from the first section to the second section.

7. The device according to claim 6, further comprising apertures disposed between the outlets of the first panel, allowing for a portion of the mixture to pass to a second surface of the first panel.

8. The device according to claim 1, wherein a second surface of the first panel comprises a plurality of divider microstructure feed slots that align with the plurality of divider microstructures on the first surface, further wherein each of the divider microstructure feed slots comprises a plurality of feed apertures that provide a pathway for communication of fluid from within the divider microstructure feed slots.

9. The device according to claim 8, wherein a plurality of divider microstructure grooves cooperate as a second plenum.

10. The device according to claim 9, wherein the plurality of feed apertures extend between the feed pathways between adjacent divider microstructures.

11. A device, comprising:

a first panel;

a first plurality of raised features extending from a first surface of the first panel, the first plurality of raised features being spaced apart from one another and disposed at an end of one edge of the first panel to form first inlets;

a second plurality of raised features extending from the first surface of the first panel, the second plurality of raised features being spaced apart from one another and disposed at an end of a second edge of the first panel to form outlets;

a plurality of divider microstructures extending from the first surface of the first panel in line with and in between the first plurality of raised features and the second plurality of raised features, wherein at least a portion of adjacent divider microstructures are spaced apart to form feed pathways, wherein the plurality of divider microstructures are arranged into rows, wherein each of the first plurality of raised features is associated with a pair of the rows; and second inlets that provide pathways for communication of fluid from a second surface to the first surface through feed apertures extending from the feed pathways to the first surface, the pathways providing fluid in a direction that is orthogonal to the feed pathways of fluid communication of the first inlets, wherein the second inlets extend across the first panel to form continuous divider microstructure feed slots that align with the plurality of divider microstructures on the first surface.

12. The device according to claim 11, wherein the plurality of divider microstructures diverge from one another forming a substantially v-shaped outlet channel.

13. The device according to claim 12, wherein each of the pair of the rows is associated with a different one of the second plurality of raised features.

14. The device according to claim 13, further comprising a second panel disposed coupled in series with the first panel, the second panel being identical to the first panel, wherein a first fluid is passed through the first inlets of the first panel and a second fluid is passed through the second inlets of the first panel, further wherein a mixture of the first fluid and the second fluid exiting the outlets of the first panel are directed into both the first inlets of the second panel and the second inlets of the second panel to further mix the mixture.

15. The device according to claim 14, wherein a first section of the first panel and second section of the first panel are separated by a dam to prevent the mixture from crossing from the first section to the second section.

16. The device according to claim 15, further comprising apertures disposed between the outlets of the first panel, allowing for a portion of the mixture to pass to a second surface of the first panel.

17. The device according to claim 11, wherein a second surface of the first panel comprises a plurality of divider microstructure feed slots that align with the plurality of divider microstructures on the first surface, further wherein each of the divider microstructure feed slots comprises a plurality of feed apertures that provide a pathway for communication of fluid from within the divider microstructure feed slots.

18. The device according to claim 17, wherein a plurality of divider microstructure grooves cooperate as a second plenum.

19. The device according to claim 18, wherein the plurality of feed apertures extend between the feed pathways between adjacent divider microstructures.

* * * * *